US007207461B2

(12) United States Patent
Mitchell et al.

(10) Patent No.: US 7,207,461 B2
(45) Date of Patent: Apr. 24, 2007

(54) DISPENSER FOR SHEET MATERIAL

(75) Inventors: Joseph Mitchell, Alpharetta, GA (US); Debra N. Welchel, Woodstock, GA (US); Herb F. Velazquez, Neenah, WI (US); Tim J. Morton, Chicago, IL (US); Joel G. Delman, Chicago, IL (US); Melanie L. Andres, Chicago, IL (US); John B. Freese, Evanston, IL (US); Donna Ann Piacenza, Chicago, IL (US); David J. McCutcheon, Evanston, IL (US); Amar A. Patel, Arlington Heights, IL (US); David W. Kapiloff, Gainesville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 115 days.

(21) Appl. No.: 10/439,421

(22) Filed: May 16, 2003

(65) Prior Publication Data

US 2004/0251590 A1 Dec. 16, 2004

(51) Int. Cl.
*A47K 10/24* (2006.01)

(52) U.S. Cl. ..... 221/45; 221/283; 242/598.5

(58) Field of Classification Search ..... 221/34, 221/47, 46, 283, 48, 45, 63, 285; 242/596, 242/596.8, 590, 597, 597.8, 598, 598.5
See application file for complete search history.

(56) References Cited

U.S. PATENT DOCUMENTS

| | | | |
|---|---|---|---|
| 2,122,048 | A | 6/1938 | Shapiro |
| 2,765,909 | A | 10/1956 | Graham |
| RE24,906 | E | 12/1960 | Ulrich |
| 3,301,746 | A | 1/1967 | Sanford et al. |
| 3,322,617 | A | 5/1967 | Osborne |
| 3,612,264 | A | 10/1971 | Trunick |
| 3,824,953 | A | 7/1974 | Boone |
| 3,836,044 | A | 9/1974 | Tilp et al. |
| 3,837,595 | A | 9/1974 | Boone |
| 3,857,731 | A | 12/1974 | Merrill, Jr. et al. |
| 3,921,802 | A | 11/1975 | Thompson |
| 3,986,479 | A | 10/1976 | Bonk |
| 3,995,582 | A | 12/1976 | Douglas |
| 4,106,616 | A | 8/1978 | Boone |
| 4,106,617 | A | 8/1978 | Boone |
| 4,190,321 | A | 2/1980 | Dorer et al. |
| 4,235,333 | A | 11/1980 | Boone |
| 4,610,357 | A | 9/1986 | Nakamura |
| 4,620,502 | A | 11/1986 | Kimble |

(Continued)

FOREIGN PATENT DOCUMENTS

| | | |
|---|---|---|
| CA | 2305110 | 10/2001 |

(Continued)

*Primary Examiner*—Patrick Mackey
*Assistant Examiner*—Kaitlin Joerger
(74) *Attorney, Agent, or Firm*—Sue C. Watson

(57) ABSTRACT

A dispenser containing sheets, for example, dry sheets and premoistened sheets is provided. The dispenser is adapted to be releasably coupled to a conventional rolled product fixture, such as one that holds a roll of toilet tissue in a bathroom. The dispenser may include a cartridge which is positioned in the housing of the dispenser which holds sheets. The sheets dispense from the cartridge and the dispenser.

31 Claims, 15 Drawing Sheets

U.S. PATENT DOCUMENTS 4,638,921 A 1/1987 Sigl et al.
4,651,874 A 3/1987 Nakamura
4,653,250 A 3/1987 Nakamura
4,739,879 A 4/1988 Nakamura
4,741,944 A 5/1988 Jackson et al.
4,834,316 A 5/1989 DeLorean
4,865,221 A 9/1989 Jackson et al.
4,913,312 A 4/1990 Boutin
5,048,589 A 9/1991 Cook et al.
5,102,007 A * 4/1992 Petterson et al. ..... 221/6
5,194,299 A 3/1993 Fry
5,265,758 A 11/1993 Saint Criq et al.
5,311,986 A 5/1994 Putz
5,399,412 A 3/1995 Sudall et al.
5,409,181 A 4/1995 Patrick
5,439,521 A 8/1995 Rao
5,607,551 A 3/1997 Farrington et al.
5,618,008 A 4/1997 Dearwester et al.
5,620,148 A 4/1997 Mitchell
5,629,081 A 5/1997 Richards et al.
5,656,361 A 8/1997 Vogt et al.
5,660,636 A 8/1997 Shangold et al.
5,672,248 A 9/1997 Wendt et al.
5,765,717 A 6/1998 Gottselig
5,897,074 A 4/1999 Marino
5,950,863 A * 9/1999 Schutz et al. ..... 221/46
5,950,960 A * 9/1999 Marino ..... 242/594.5
5,951,762 A 9/1999 Shangold et al.
5,964,351 A 10/1999 Zander
6,047,920 A 4/2000 Dearwester et al.
6,056,235 A 5/2000 Brozinsky
6,098,836 A 8/2000 Gottselig
6,098,919 A 8/2000 Lewis
6,170,698 B1 1/2001 Phelps et al.
6,230,929 B1 * 5/2001 Phelps et al. ..... 221/46
6,296,143 B1 * 10/2001 Ghabriel ..... 221/34
6,328,252 B1 12/2001 Neveu et al.
6,346,153 B1 2/2002 Lake et al.
6,382,552 B1 5/2002 Paul et al.
6,439,384 B2 8/2002 Sauer et al.
6,439,386 B1 * 8/2002 Sauer et al. ..... 206/494
6,857,540 B2 * 2/2005 Mitchell ..... 221/45
2002/0063136 A1 5/2002 Sauer et al.
2002/0092789 A1 7/2002 Sauer et al.
2003/0075551 A1 4/2003 Dailey, III
2003/0192903 A1 10/2003 Sauer et al.

FOREIGN PATENT DOCUMENTS

EP 0459110 12/1991
EP 0568987 7/1997
EP 1129656 A1 9/2001
GB 2270901 3/1994
WO 94/14365 7/1994
WO 98/04486 2/1998
WO 00/65973 11/2000
WO 01/76436 10/2001
WO 01/76440 10/2001
WO WO 01/76439 10/2001
WO 01/89935 11/2001
WO 02/21988 3/2002
WO 02/21989 3/2002

* cited by examiner

DISPENSER FOR SHEET MATERIAL

BACKGROUND OF THE INVENTION

The use of single sheets provided as interfolded dry sheets for bath tissue has been widely accepted. Such single interfolded sheets often provide less waste than traditional rolled bath tissue. Similarly, the use of premoistened or "wet" sheets has gained wide acceptance for a variety of uses, particularly premoistened bathroom applications. The dry sheets and premoistened sheets are generally formed from an absorbent material such as a paper or a polymeric web, or combinations thereof, and may contain a disinfectant, medicant, deodorant, anti-microbial, anti-bacterial, cleansing agent, and so forth, in one or more combinations, on a dry sheet, or in a "wet" formulation on a premoistened sheet. Premoistened sheets are generally stored and dispensed from a sealable container to prevent the sheets from drying out.

Various dispenser designs for dry and/or premoistened sheets have been used with existing bathroom fixtures, such as fixtures for conventional rolled products. These dispensers are often cumbersome and bulky, and they are problematic with regard to space and mounting considerations. Refilling one or both dispensers can also be difficult.

Accordingly, it would be desirable to provide a dispenser capable of dispensing dry and/or premoistened sheets from a conventional rolled product fixture, such as a standard fixture for rolled bath tissue. Such a dispenser would provide a housing which is configured to accept a quantity of sheets and/or one or more cartridges providing dry and/or premoistened sheets.

DEFINITIONS

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

These terms may be defined with additional language in the remaining portions of the specification.

SUMMARY OF THE INVENTION

In response to the difficulties and problems discussed above, a dispenser which is adapted to releasably couple to a conventional rolled product fixture is provided. The dispenser includes a housing having a compartment for holding sheets therein and the housing includes a dispensing opening therein. The housing is disposed at an oblique angle and positioned such that a first axis extends through a highest vertex and a lowest vertex of the housing. The housing is positioned such that a second axis extends through a depth dimension of the housing. The sheets dispense through the dispensing opening which is positioned between the first axis and the second axis, on a third axis.

In another aspect of the invention, a dispenser which is adapted to releasably couple to a conventional rolled product fixture is provided. The dispenser includes a housing having a compartment for holding sheets therein. The housing includes two spaced-apart and opposing sidewalls and at least a portion of a lower end. The housing also includes an upper end configured to releasably couple to a fixture. The housing is configured to have an opening into the compartment and has prong members positioned therein which are configured to releasably couple to a cartridge containing sheets which is positioned in the compartment.

In yet another aspect of the invention, a dispenser which is adapted to releasably couple to a conventional rolled product fixture is provided. The dispenser includes a housing which includes a compartment for holding sheets therein. The housing has a substantially parabolic cross-section. The housing includes a cover, and the housing and the cover each having an upper end which wraps about a substantial portion of a roll mount of a fixture to releasably couple it thereto. The upper end of the cover moves over the upper end of the housing to permit the cover to be opened to access the compartment. The housing is configured to hold a plurality of sheets having a substantially polygonal configuration in the compartment. The housing includes a dispensing opening through which sheets are dispensed.

DETAILED DESCRIPTION

Figure 1:
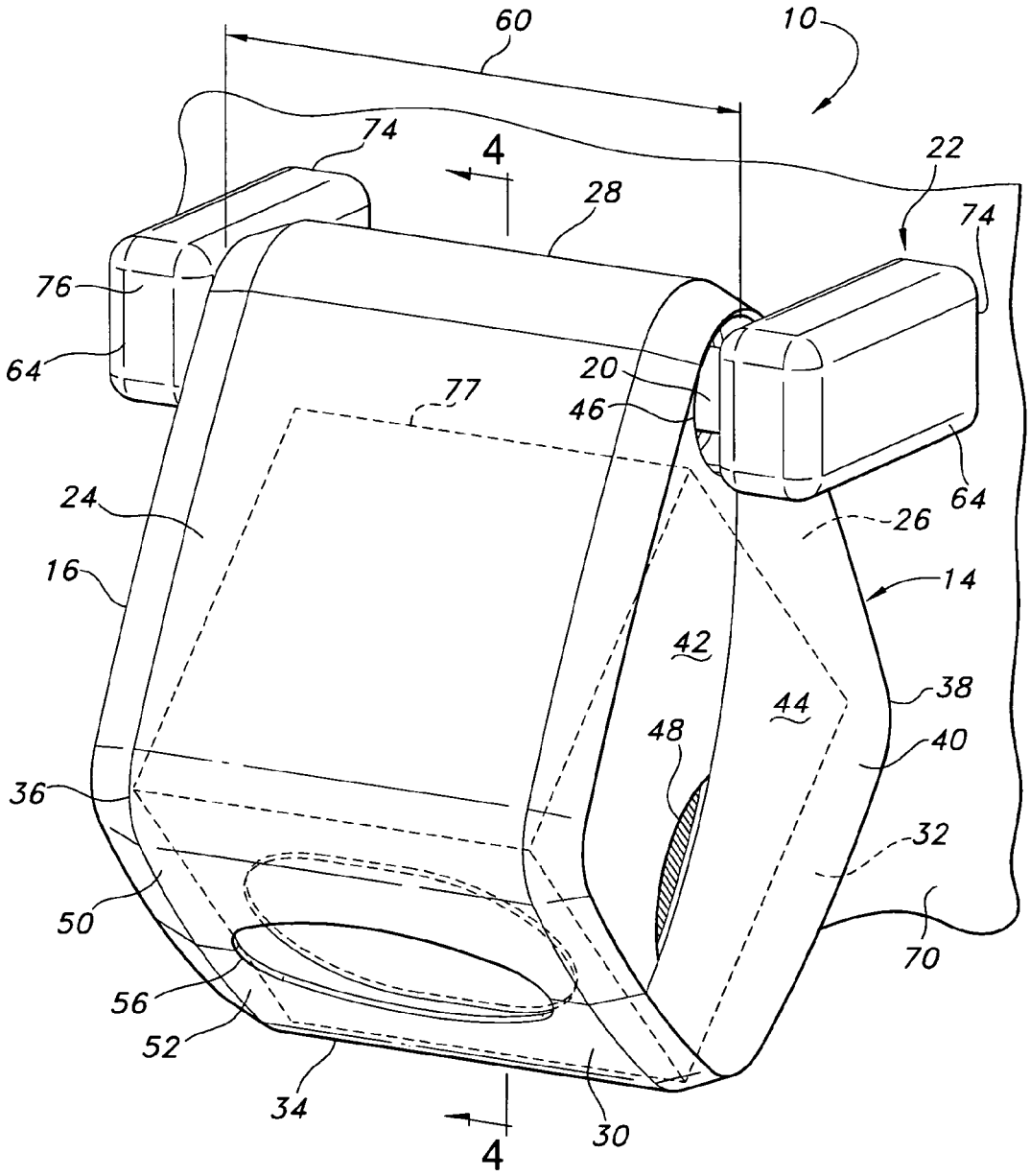
FIG. 1 is a perspective view of an embodiment of the dispenser of the present invention as it is releasably coupled to a conventional rolled product fixture attached to a vertical support surface, a cartridge of dry sheets illustrated by phantom lines.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to the FIGS. 1–17 in general, a dispenser is provided for storing and dispensing sheets. It should be appreciated that the present invention is not limited to any particular type of sheets. The dispenser, however, is well suited for dispensing individual stacked interfolded sheets, as generally illustrated in the figures. Non-limiting examples of dry sheets are disclosed in U.S. Pat. No. 3,301,746 to Sanford et al., U.S. Pat. No. 3,322,617 to Osborne, U.S. Pat. No. 5,048,589 to Cook et al., U.S. Pat. No. 5,399,412 to Sudall et al., U.S. Pat. No. 5,607,551 to Farrington et al., and U.S. Pat. No. 5,672,248 to Wendt et al., all of which are incorporated by reference herein in their entirety. Non-limiting examples of premoistened sheets are disclosed in U.S. Pat. Nos. 4,741,944 and 4,865,221, both to Jackson et. al., U.S. Pat. No. 5,629,081 to Richards et al., U.S. Pat. No. 5,656,361 to Vogt et al., and U.S. Pat. No. 5,964,351 to Zander, all of which are incorporated by reference in there entirety herein. Such stacked, interfolded, and/or festooned configurations for dry sheets, such as toilet tissue sheets and/or premoistened sheets are well known to those of ordinary skill in the art and need not be described in great detail herein.

Figure 2:
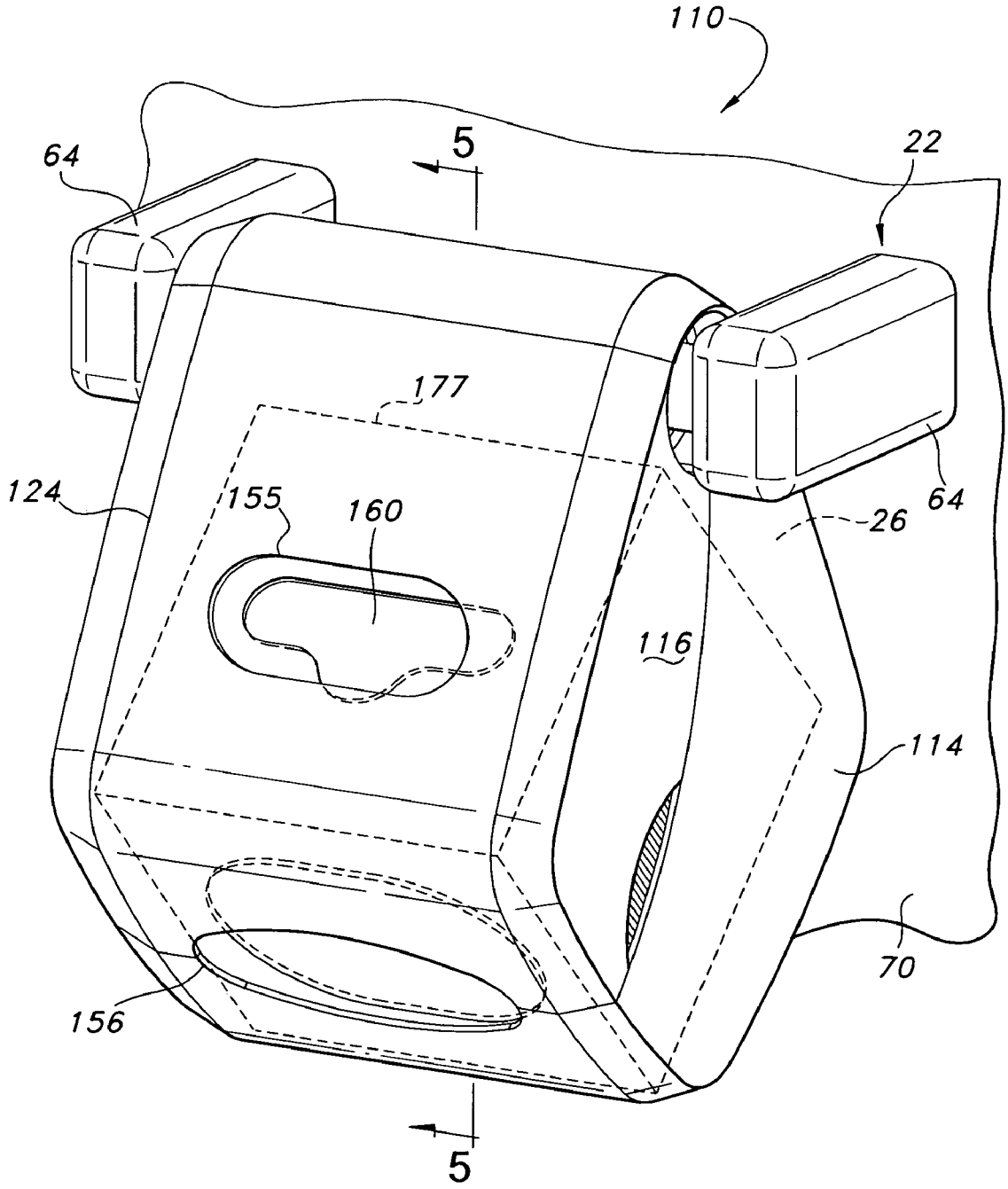
FIG. 2 is a perspective view of another embodiment of the dispenser of the present invention as it is releasably coupled to a conventional rolled product fixture, a cartridge containing dry sheets and a container of premoistened sheets illustrated by phantom lines.
Figure 3:
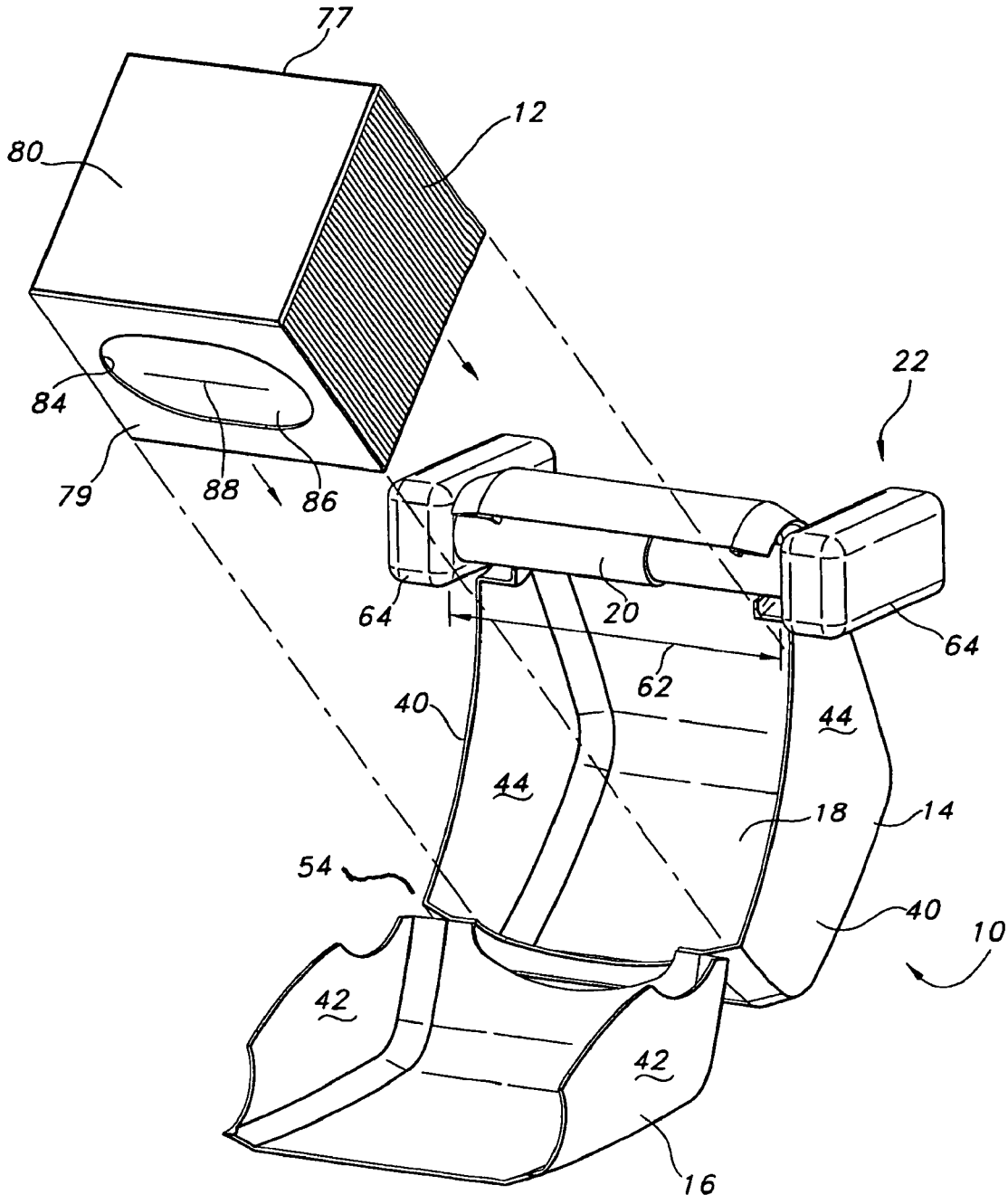
FIG. 3 is an exploded perspective view of the dispenser of FIG. 1 releasably coupled to the fixture but being opened to show the compartment therein and the positioned in which the cartridge of dry sheets are to be disposed therein.
Figure 4:
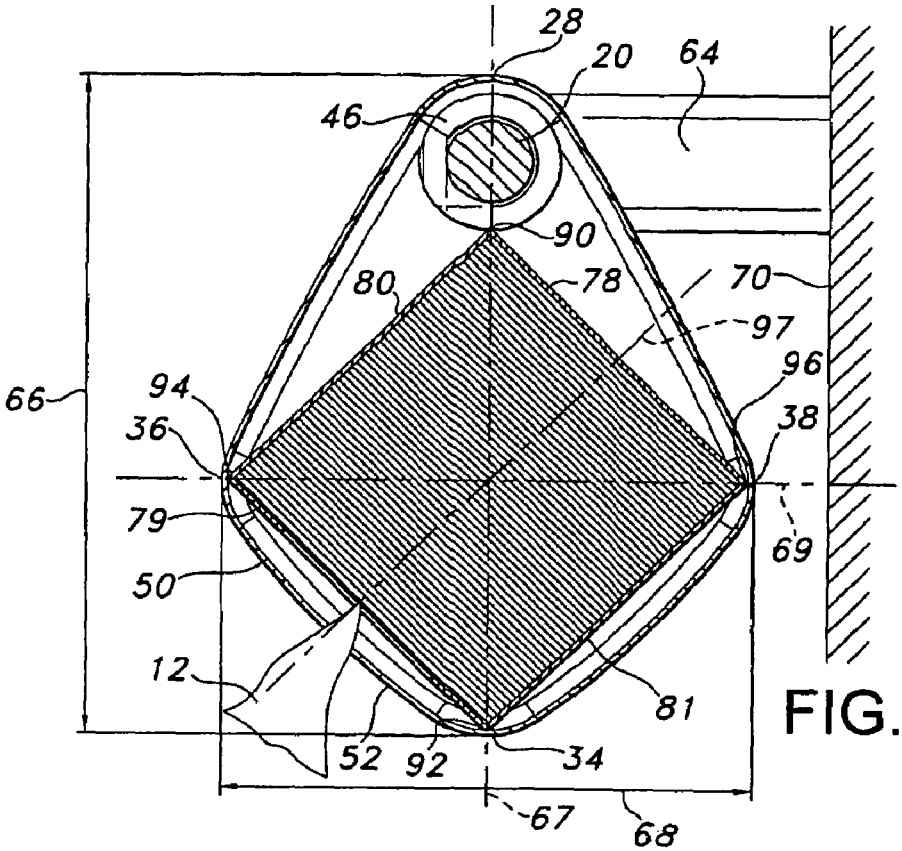
FIG. 4 is a sectional view of FIG. 1 taken along line 4—4, illustrating the position of the cartridge of dry sheets in the compartment.
Figure 5:
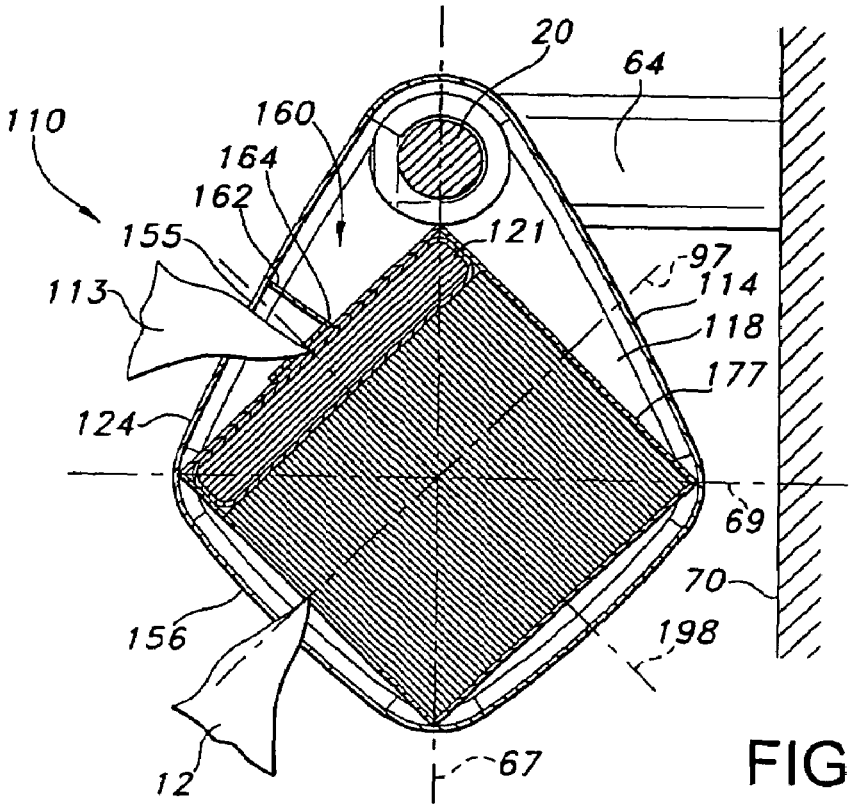
FIG. 5 is a sectional view of FIG. 2 taken along line 5—5, illustrating the position of the cartridge including dry sheets and the container of premoistened sheets in the compartment.

The dispenser shown in FIGS. 1, 3, and 4 discloses a dispenser which releasably couples to a conventional rolled product fixture and extends diagonally therefrom to provide dry sheets for bath or toilet tissue. The dispenser shown in FIGS. 2 and 5 is similar to the previous dispenser, but dispenses premoistened sheets as well as dry sheets therefrom.

Turning now to FIGS. 1, 3 and 4, a dispenser 10 according to the invention is provided for dispensing dry sheets 12. The dispenser 10 includes a housing 14 which has a cover 16. When the cover 16 is closed, the housing 14 and cover 14 cooperate to provide a compartment 18 from which dry sheets 12 may be positioned for dispensing therefrom. As illustrated in FIGS. 1, 3 and 4, the dispenser 10 is suspended from a roll mount 20 of a conventional rolled product fixture 22.

As illustrated in FIGS. 1 and 4, the housing 14, when in a closed, dispensing position includes front and back upper walls 24, 26, a portion of each connect at a junction and extend over the roll mount 20 to provide an upper vertex or upper corner 28 of the housing 14. The front and back upper walls 24, 26 are positioned relative to each other at an acute angle. The acute angle between the front and back upper walls 24, 26 is desirably between about 25 to about 50 degrees. Similarly, the housing 14 also includes front and back lower walls 30, 32 which connect at a junction to provide a lower vertex or lower corner 34 of the two lower walls 30, 32, respectively. The front and back lower walls 30, 32 form angles of about 80 to about 100 degrees relative to each other. That is, the front and back lower walls 30, 32 are desirably about perpendicular to each other. A front lateral corner 36 is provided at the junction of the front upper and front lower walls 24, 36. A back lateral corner 38 is provided at the junction of the back upper and back lower walls 26, 32. An obtuse angle of desirably between about 100 to about 150 degrees is formed at the junction of each upper wall to each lower wall. Spaced-apart side walls 40 are coupled to front and back upper and lower walls 30, 32. All walls 24, 26, 30, 32 and 40 cooperate to provide both the housing 14 and the cover 16.

Each side wall 40 may be separated in two separate front and back sections 42, 44, each of which extends from an opening 46 adjacent the upper corner 28 in each side wall 40. In addition, the front and back sections 42, 44 may cooperate to provide an aperture 48 which reveals the amount of dry sheets 12 remaining in the compartment 18. This aperture 48 provides an indication of whether there are sufficient dry sheets 12 remaining in the compartment 18, or whether a refill may be needed. Alternatively, the aperture may be formed in any portion of the dispenser 10 (not shown).

Further, the front lower wall 30 may be separated into upper and lower portions 50, 52. The upper portion 50 is desirably formed with each front section 42 of each side wall 40, while the lower portion 52 is formed with each back section 44 of each side wall 40. In this manner, these separated structures cooperate to provide an opening 54 into the housing 14 and cooperate to provide the cover 16 for the housing 14. The cover 16 provides access to the compartment 18 for disposing dry sheets 12 therein, as well as a closure for the housing 14, so that the dry sheets 12 may be dispensed therefrom. It will be appreciated that the housing 14 and the cover 16 may be connected together by hinges, such as living hinges, latches, fasteners, and so forth.

A dispensing opening 56 is desirably provided in a front lower wall 30 at the junction of the upper and lower portions 50, 52 of the front lower wall 30 to permit dispensing of the dry sheets 12 disposed in the housing 14. However, the dispensing opening 56 and any dispensing opening shown and/or described herein may be provided in any wall, portion of wall(s) any corner and/or any combination of thereof (not shown) of the housing 14 in any embodiment described and/or illustrated herein, however, to dispense any sheet shown and/or described herein. It will be appreciated that the dispensing opening 56 and any dispensing opening shown and/or described herein may assume any suitable shape or configuration.

Referring to FIG. 1, at least the upper corner 28 of the housing 14 has a configuration with a width dimension 60 which extends between opposing side walls 40 which is less than the width dimension 62 between the support arms 64 provided by a conventional rolled fixture 22. The various dimensions of the housing 14 are desirably configured such that the dispenser 10 may be coupled to and supported by the conventional roll product fixture 22. Such fixtures are well known and a typical fixture is illustrated in FIGS. 1, 3 and 4. Desirably, the housing 14 also has a length dimension 66 which extends between upper and lower corners 28, 34. A first axis 67 extends through the upper and lower corners (vertices) 28, 34. A depth dimension 68 extends between the front and back lateral corners 36, 38. A second axis 69 extends through the front and back lateral corners 36, 38 as well.

Such a fixture 22 has at least a side support arms 64 mounted to and extending transversely from a generally vertically disposed support surface 70. Alternatively, the support arms 64 are coupled to a base or back member (not shown). As shown in FIG. 1, each of the side support arms 64 extend from a coupled end 74 to a free end 76 of the support arm 64, which often has a recess (not shown). Typically, a roll mount 20 extends across the width dimension 62 of the support arms 64 to releasably couple to the support arms 64, as shown in FIG. 3. The roll mount 20 typically includes a protruding member on each end (not shown). The protruding member is desirably releasably positioned in the recess (not shown) to couple the roll mount 20 to the support arms 64. The roll mount 20 in the present embodiment, for example, is a conventional spindle.

The roll mount 20 is positioned through the openings 46 in the sidewalls 40 provided near the upper corner 38 of the housing 14, so that the dispenser 10 may be releasably coupled to the roll mount 20 and the fixture 22. As used herein, the term "roll mount" includes a spindle, and also includes a pair of prongs mounted on each support arm in a confronting relationship, such that may be used with a coreless bath tissue roll, such as, by way of example and not limitation, the one illustrated and described in detail in U.S. Pat. No. 5,620,148 to J. Mitchell, which is hereby incorporated by reference in its entirety herein.

In the embodiments illustrated herein, the width dimension 60 of the housing 14 permits at least a portion of the housing 14 to be positioned between the support arms 64 when the portion is coupled to the roll mount 20. The width dimension between the support arms 64 is typically in a range of about 6.0 inches to about 4.0 inches.

The housing 14 desirably, as noted previously, has a width dimension 60 that permits it to fit between the support arms 64 of the fixture 22. The width dimension 60 of the housing 14, at least the portion of the housing 14 positioned between the support arms 64, is desirably in a range of about 5.5 inches to about 4.7 inches. Even more desirably, the width dimension 60 is in a range of about 5.25 inches to about 4.6 inches. Yet even more desirably, the width dimension 60 is in a range of about 5.25 inches to about 4.5 inches.

The housing 14 or any housing shown and/or described herein may be formed from any conventional material. The housing may be formed from a relatively inexpensive material as well. In addition, the housing may be refillable; alternatively, the housing may be non-refillable, and may be disposed of when the last sheet is withdrawn. Materials for the housing 14 include, but not by way of limitation, metal, plastic, wood, fabric, fiber, paper, paperboard, cardboard, polymer film, cellophane, any combination thereof, and so forth. The housing 14 and any housing shown and/or described herein may be provided in any shape or configuration, and the present embodiment is provided as a non-limiting example thereof.

The dispenser 10 may be opened when the cover 16 is moved away from the housing 14, as illustrated in FIG. 3, so that the dry sheets 12 may be positioned in the compartment 18. Such dry sheets 12 are desirably provided as, by way of non-limiting example, a plurality of sheets, as illustrated in FIGS. 3 and 4. Such a plurality of dry sheets 12 may be provided as an unbound group or stack of sheets. Desirably, the dry sheets 12 are provided in a cartridge 77 of dry sheets 12. Such a cartridge 77 may be provided by a band holding the plurality of sheets 12 together (not shown). Such a cartridge 77 may also be formed about the dry sheets 12 to provide upper and lower surfaces 78, 79, as well as front and back walls 80, 81. Optionally, the cartridge 77 may provide side walls (not shown). Such a cartridge 77 is provided so that an amount of dry sheets 12 that reasonably fills the compartment 18 is provided in a single group and held by the cartridge 77.

An opening 84 is provided in at least one surface or wall of the cartridge 77, in the present embodiment, the lower surface 79 of the cartridge 77, to permit dispensing of the dry sheets 12. It will be understood that the opening 84 may be provided in any wall, surface and/or structure of the cartridge 77; it will be appreciated that the opening 84 may assume any shape or configuration. The opening 84 may be covered, for example, but not by way of limitation, by a plastic film 86 which has a slit 88 therein, as illustrated in FIG. 3, and so forth. The opening 84 may be formed from perforated portions that, when removed, provide the opening (not shown), and so forth.

The cartridge 77 or any cartridge shown and/or described herein may be formed from any material, such as, by way of non-limiting example, paper, paperboard, plastic, polymer film, cellophane, and any combination(s) of the foregoing. While the dispenser 10 is designed to be filled by at least one cartridge 77, it will be appreciated that the cartridge 77 may desirably be non-refillable and is therefore desirably disposable of when the last dry sheet 12 is withdrawn therefrom.

The cartridge 77 is positioned in the compartment 18 such that the opening 84 of the cartridge 77 in the lower surface 79 thereof is positioned adjacent the front lower wall 30 of the housing 14 and in alignment with the dispensing opening 56 therein, to permit dispensing of dry sheets 12 from both the cartridge 77 and the dispenser 10. The cartridge 77 is desirably positioned at an oblique angle relative generally to the vertical support surface, as illustrated in FIG. 4. However, the front wall 80 and upper surface 78 adjacent to the upper corner 28 of the housing 14 and the lower surface 79 and the back wall 81 adjacent to the lower corner 34 of the housing 14 each may desirably be provided at about a 90 degree angle relative to each other. Similarly, the front wall 80 and the lower surface 79 adjacent to the front lateral corner 36 of the cartridge 77 and the upper surface 78 and the back wall 81 have adjacent to the back lateral corner 38 of the cartridge 77 may also desirably be provided at about a 90 degree angle relative to each other. The upper corner 28 of the housing 14 and the upper corner 90 of the cartridge 77 and lower corner 34 of the housing 14 and a lower corner 92 of the cartridge 77 may desirably be in an alignment along the first axis 67. The front lateral corner 36 of the housing 14 and a front lateral corner 94 of the cartridge 77 may be in alignment with the back lateral corner 38 of the housing 14 and a back lateral corner 96 of the cartridge 77 along a second axis 69. The first axis 67 and second axis 69 desirably may be, but not by way of limitation, oriented perpendicularly relative to each other. Desirably, but not by way of limitation, the cartridge 77 has a substantially polygonal configuration. The dry sheets 12 dispense in alignment with a third axis 97 which intersects and is positioned at an acute angle relative to the first axis 67 and the second axis 69.

The housing 14 is provided such that the back lateral corner 38 is adjacent the vertical support surface 70. All corners, that is the upper and lower corners 28, 34 and the front and back lateral corners 36, 38 are rounded to prevent any damage to the vertical support surface 70 and to provide safe surfaces for user safety.

In another embodiment of the invention, as illustrated in FIGS. 2 and 5, the dispenser 110 and housing 114 are very similar to the dispenser 10 and the housing 12 shown in FIGS. 1, 3 and 4, and previously described in detail herein. The dispenser 110, however, is adapted to provide premoistened sheets 113 as well as dry sheets 12 in a single housing 114. The compartment 118 contains a cartridge 177 of dry sheets 12 which also includes, by way of example and not limitation, a container 121 of premoistened sheets 113 as well. The container 121 of premoistened sheets 113, as illustrated in FIG. 5, may be formed as a part of the cartridge 177. Alternatively, however, the container 121 of premoistened sheets 113 may be provided separately, without having any attachment to the cartridge of dry sheets (not shown), or it may be provided as a separate container which is coupled to the cartridge (not shown). The premoistened sheets 113 are dispensed from the container 121 within the cartridge 177 from openings (not shown) in the container 121 and cartridge 177 and through a first dispensing opening 155 in the housing 114. The dry sheets 12 are dispensed from another opening in the cartridge 177 and through a second dispensing opening 156 in the housing, as shown in FIG. 5.

The first dispensing opening 155 desirably is provided, by way of non-limiting example in an upper front wall 124. The portion of the cartridge 177 having the container 121 of premoistened sheets 113 is exposed through the first dispensing opening 155, which provides access thereto. The container 121 also includes an opening (not shown) which permits access to the premoistened sheets 113.

As illustrated in FIGS. 2 and 5, the compartment 118 or any compartment shown and/or described herein may be an integral unit such that it contains a cartridge 177 having both the container 121 of premoistened sheets 113 and the group of dry sheets 12, or, as previously described, one cartridge of dry sheets and a separate container of premoistened sheets (coupled to or uncoupled from the cartridge). However, alternatively, the housing 114 or any housing shown and/or described herein may include first and second compartments formed separately such that one compartment holds a container of dry sheets and another compartment holds premoistened sheets (not shown). Such compartments may be delineated by separate cartridges or containers, or, by way of non-limiting example, the housing may have at least a portion of an inner wall (not shown) in which to provide first and second compartments (not shown).

The premoistened sheets 113 may be encased in a liquid impermeable film, and this film may provide a portion, or all, of the container 121 as shown in FIG. 5. In a further example, the container 121 may be formed from at least one other material, and the container 121 may be lined with the film (not shown).

As shown in FIG. 2, a resealable cover 160 may be positioned over an opening in the cartridge 177 to the container 121 of premoistened sheet 113. The resealable cover 160 is then accessed through the first dispensing opening 155 in the housing 114, which is aligned over the resealable cover 160 (FIG. 5), to permit dispensing of the premoistened sheets 113 disposed in the container 121 and the cartridge 177. Alternatively, or, in addition thereto, the housing 114 may also include a resealable cover which is positioned over the first dispensing opening on the housing to permit access to the premoistened sheets as well (not shown).

The resealable cover 160 is used to maintain the moisture conditions within the container 121 and to prevent undesired drying out of the premoistened sheets 113. In a non-limiting example of one possible resealable cover 160, FIGS. 2 and 5 discloses a resealabe cover 160 which includes an upper flap 162 (FIG. 5) which is coupled to a portion of a lower flap 164, which has a slit or opening therein (not shown), through which the premoistened sheets 113 are withdrawn. The resealable cover 160 in this embodiment is positioned over the opening in the cartridge 177 and container 121. The upper flap 162 releasably engages the lower flap 164 to provide a releasable closure to the cartridge 177 and the container 121. Such releasable and resealable features between the upper and lower flaps 162, 164 is provided, by way of non-limiting example, by an adhesive, such as a pressure sensitive adhesive, a cohesive adhesive, such as a latex or other natural rubber material, and so forth. Other resealable mechanisms, such as, by way of non-limiting example, snap-fit, hinged cover and lid, and so forth are known in the art may be used; any resealable mechanism known in the art may be used with the housing and/or over the openings to the cartridge and/or the container.

The premoistened sheets 113 dispense at an acute angle relative to the first axis 67 and the second axis 69. The premoistened sheets 113 dispense along a fourth axis 198 which may be about perpendicular to the third axis 97. The fourth axis intersects the first axis 67, the second axis 69 and the third axis 198.

It will be understood that the position of the premoistened sheets 113 and dry sheets 12 within the housing 114 or any housing shown and/or described herein may be reversed, and they need not be in a specific configuration, and may take on any suitable arrangement, including a stacked arrangement, a side-by-side arrangement, a coaxial arrangement, and so forth. Any number of configurations may be used for simultaneously dispensing dry sheets 12 and premoistened sheets 113 from a single housing 114. All such configurations are within the scope and spirit all embodiments of the present invention shown and/or described herein. In addition, any housing shown and/or described herein may use or incorporate any feature, element and/or characteristic shown and/or described herein.

Another embodiment of the present invention is illustrated in FIGS. 6, 8, 10 and 11. The dispenser discloses a housing which releasably couples to a conventional rolled product fixture. The housing acts as a shield and a holder for a cartridge of dry sheets for use as toilet tissue. The dispenser disclosed in FIGS. 7 and 12 (and the cartridge in FIG. 9) are similar, but the dispenser is configured to dispense premoistened sheets as well as dry sheets.

Turning to FIGS. 6, 8, 10 and 11, a dispenser 210 according to another aspect of the invention is provided for dispensing dry sheets 12. The dispenser 210 includes a housing 214 which may be open on one side thereof for receiving the dry sheets 12 in a compartment 218 formed in the housing 12. Desirably, the dry sheets 12 are provided in a cartridge 277. The dispenser 210 is suspended from a roll mount 20 of a conventional rolled product fixture 22 having support arms 64.

The housing 214 has an upper end 223 and a curved front wall 224 which are curved along an obtuse angle relative to each other. The angle is desirably between about 91 and about 175 degrees. Even more desirably, the angle is between about 95 and about 150 degrees. Even more desirably, the angle is between about 95 and about 145 degrees. Two spaced-apart sidewalls 240 are provided with the curved front wall 224. Each sidewall 240 has at least one opening 246 provided therein for a roll mount 20 to extend therethrough. A second opening 246 may also be provided, in each sidewall 240 to accommodate different lengths of support arms 64 of the fixture 22.

The front wall 224 includes the upper end 223 having a narrow dimension 258 sized to fit between two support arms 64 of a conventional rolled product fixture 22. The front wall 224 tapers outward from the upper end 223 to a wider dimension 228 at a lower end 230. Similarly, each sidewall 240 follows the tapered dimension of the front wall 224. Each sidewall 240 may desirably be curved along an outer edge 239.

The compartment 218 (FIG. 10), which is configured to support a cartridge 277, may have one or a plurality of support ribs (only one support rib designated by the numeral 250) to assist in holding the cartridge 277 of dry sheets 12 in a dispensing position. The housing 214 as illustrated, but not by way of limitation, may be provided without a back wall. Further, the housing 214 may also include as a lower end 252 at least a portion of a shelf 254 which provides the portion of a lower end 252 and supports the cartridge 277 of dry sheets 12 thereon. Alternatively, the housing 214 may have a complete lower end which may have one or more openings therein (not shown). The housing 214 may also include, but not by way of limitation, at least one, and desirably a pair of connecting members or prongs 256 which permit the cartridge 277 to be releasably coupled to the housing 214. The prongs 256 may be L-shaped, however, the prongs 256 may assume any configuration so long as they operate in the manner shown and/or described herein.

Figure 6:
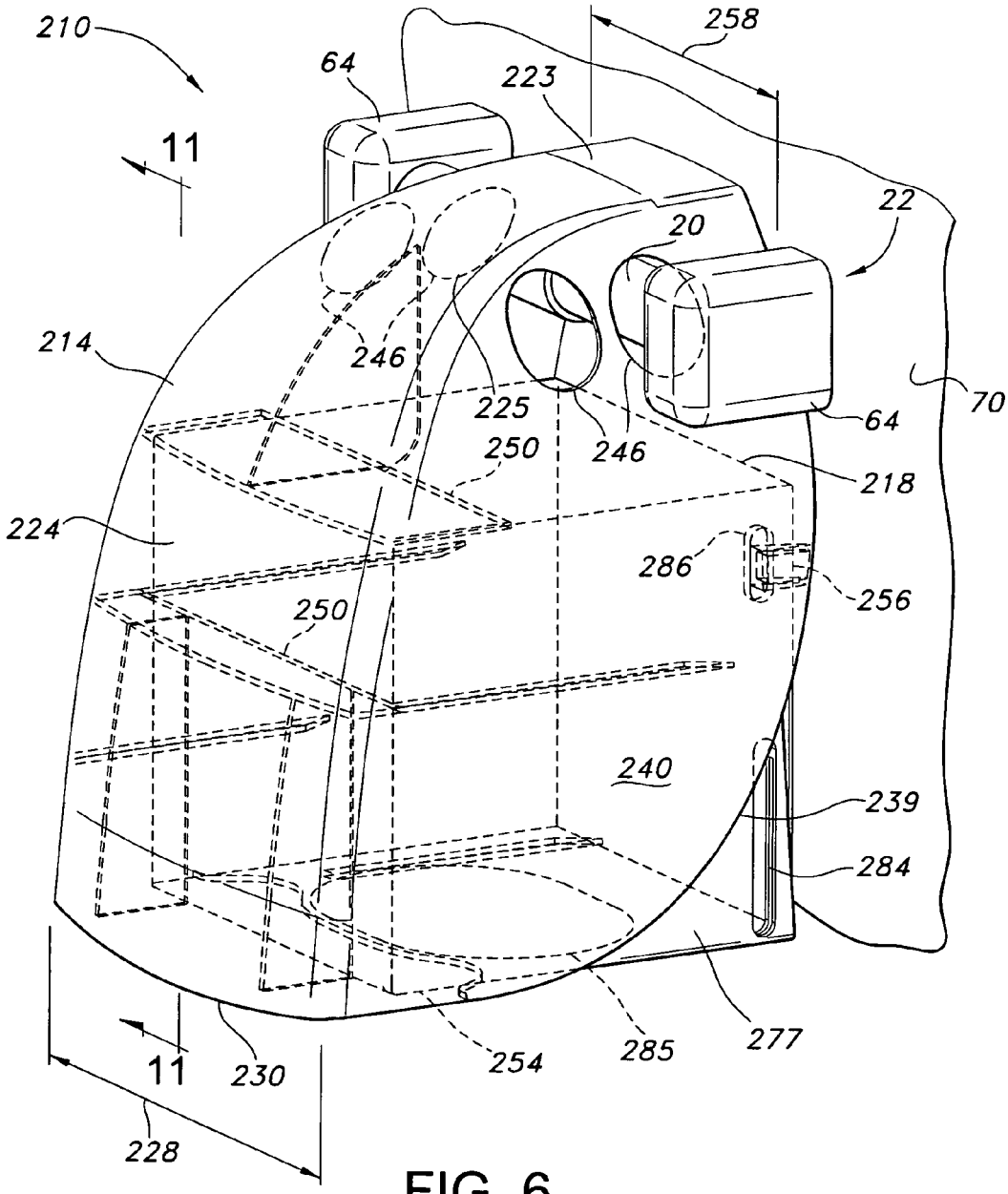
FIG. 6 is a perspective view of yet another embodiment of the dispenser of the present invention as it is releasably coupled to a conventional rolled product fixture attached to a vertical support surface, a cartridge of dry sheets illustrated by phantom lines.
Figure 11:
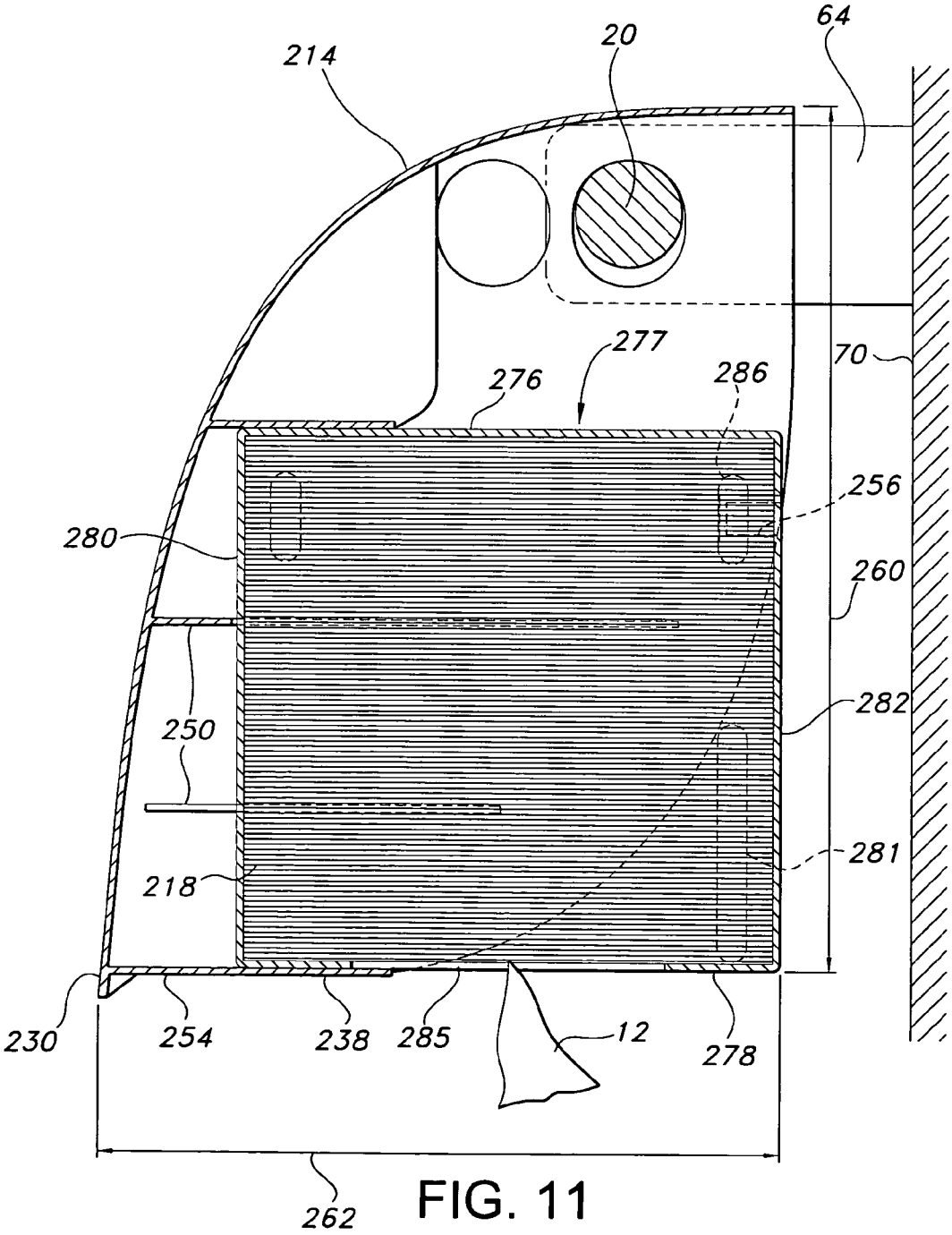
FIG. 11 is a sectional view of FIG. 6 taken along line 11—11, illustrating the position of the cartridge of dry sheets in the compartment.

Referring to FIG. 6, at least the upper end 223 of the housing 214 has a configuration which has a width dimension 258 which extends between opposing sidewalls 240 which is less than the width dimension 60 (FIG. 1) of the support arms 64 provided with the conventional rolled product 22. The width dimension 258 of the upper end 223 maybe less than the width dimension 228 of the lower end 230 of the front wall 224. The various dimensions of the housing 214 are desirably configured such that the dispenser 210 may be coupled to and supported by the fixture 22, as illustrated in FIGS. 6 and 11. Desirably, the housing 214 also has a length dimension 260 (FIG. 11) which extends from the upper end 223 of the housing 214 to a lower end 252, and a depth dimension 262 which extends between the front and back of each sidewall 240.

The width dimension 258 of the housing 214, at least the portion of the housing positioned between the support arms 64, is desirably in a range of about 5.5 inches to about 4.7 inches. Even more desirably, the dimension 258 is in a range of about 5.25 inches to about 4.6 inches. Yet even more desirably, the dimension 258 is in a range of about 5.25 inches to about 4.5 inches.

The housing 214 and the cartridge 277 may be formed from any material or combination of materials previously described herein. The housing 214 and the cartridge 277 may be provided in any shape or configuration, and the present embodiment is provided as a non-limiting example thereof. The housing 214 and the cartridge 277 may include any characteristic or feature shown and/or described herein.

Figure 10:
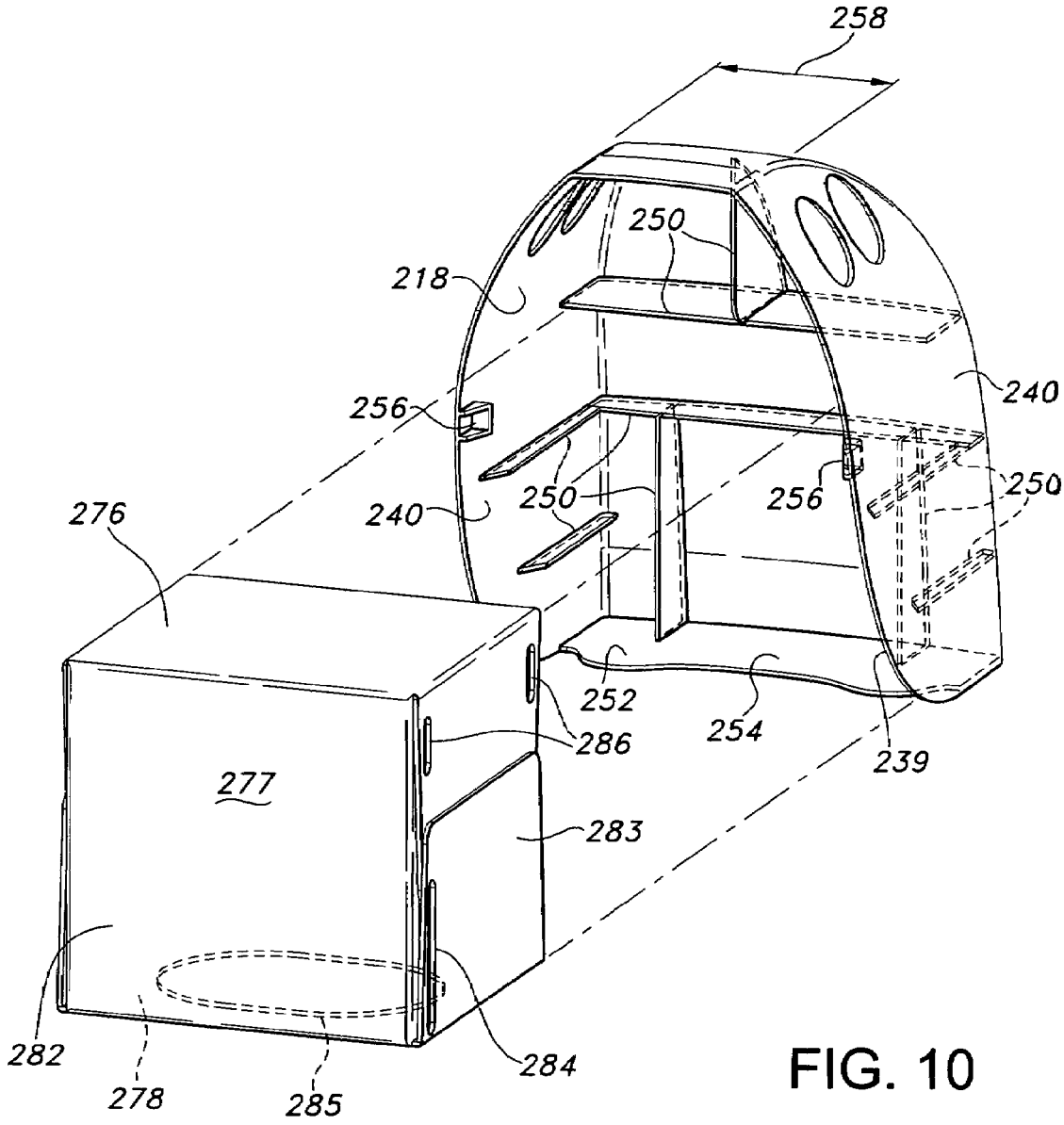
FIG. 10 is an exploded perspective view of the dispenser of FIG. 6, showing the open compartment and the positioned in which the cartridge of dry sheets are to be disposed therein.

The dispenser 210 is removed from the roll mount 20 and turned to illustrate its compartment 218, as shown in FIG. 10. Desirably, the dry sheets 12 are provided in a cartridge 277 of dry sheets 12 shown in FIG. 8 that is similar to the cartridge 77 and cartridge 177 previously illustrated and described in detail herein. Such a cartridge 277 is formed about the dry sheets 12 and may include upper and lower surfaces 276, 278, and front and back walls 280, 282. The cartridge 277 may also includes spaced apart side walls 283, and apertures 284 therein which show a user the amount of dry sheets 12 remaining in the cartridge 277.

A dispensing opening 285 is provided in at least one structure of the cartridge 277, in the present embodiment, the lower surface 278 of the cartridge 277, to permit dispensing of the dry sheets 12. It will be understood that the opening 285 may be provided in any structure or combinations of structures in the cartridge 277.

The cartridge 277 is positioned in the compartment 218 such that the dispensing opening 285 of the cartridge 277 in the lower surface 278 thereof is positioned adjacent the shelf 254 which provides at least a portion of a lower end 238 of the housing 214. The shelf 254 along with the ribs 250 support the cartridge 277 in a position for dispensing dry sheets 12 therefrom while the cartridge 277 is positioned in the housing 214. The cartridge 277 as shown in FIG. 11, specifically the back wall 282 thereof, is desirably positioned generally parallel to the vertical support surface 70, as illustrated in FIG. 11. The upper surface 276 is desirably positioned perpendicular to the vertical support surface 70. Desirably, but not by way of limitation, the cartridge 277 has a substantially polygonal configuration.

The cartridge 277 is desirably constructed from a resilient material and may include at least one opening 286 positioned in each sidewall 283. When the cartridge 277 is inserted into the compartment 218, as shown in FIGS. 6 and 10, the prongs 256 move along an outer surface of the cartridge 277 and the resilient material is pushed inward slightly until the prongs 256 engage and are pushed into the openings 286 to hold the cartridge 277 firmly buy releasably in the compartment 218 of the housing 214. When the cartridge 277 is empty, the resilient material of the cartridge 277 is squeezed slightly by a user until each prong 256 emerges from the opening 286, and the cartridge 277 is then withdrawn from the compartment 218.

The housing 214 may be provided such that a back outer edge 239 of each sidewall 240 is curved, to permit a portion of the cartridge 277 to be seen by a user. Desirably, the portion of the cartridge 277 provides at least one aperture 284 which permits a user to see the amount of dry sheets 12 remaining in the cartridge 277. In addition, the housing 214 of the dispenser 210 desirably includes rounded corners for user safety.

Figure 7:
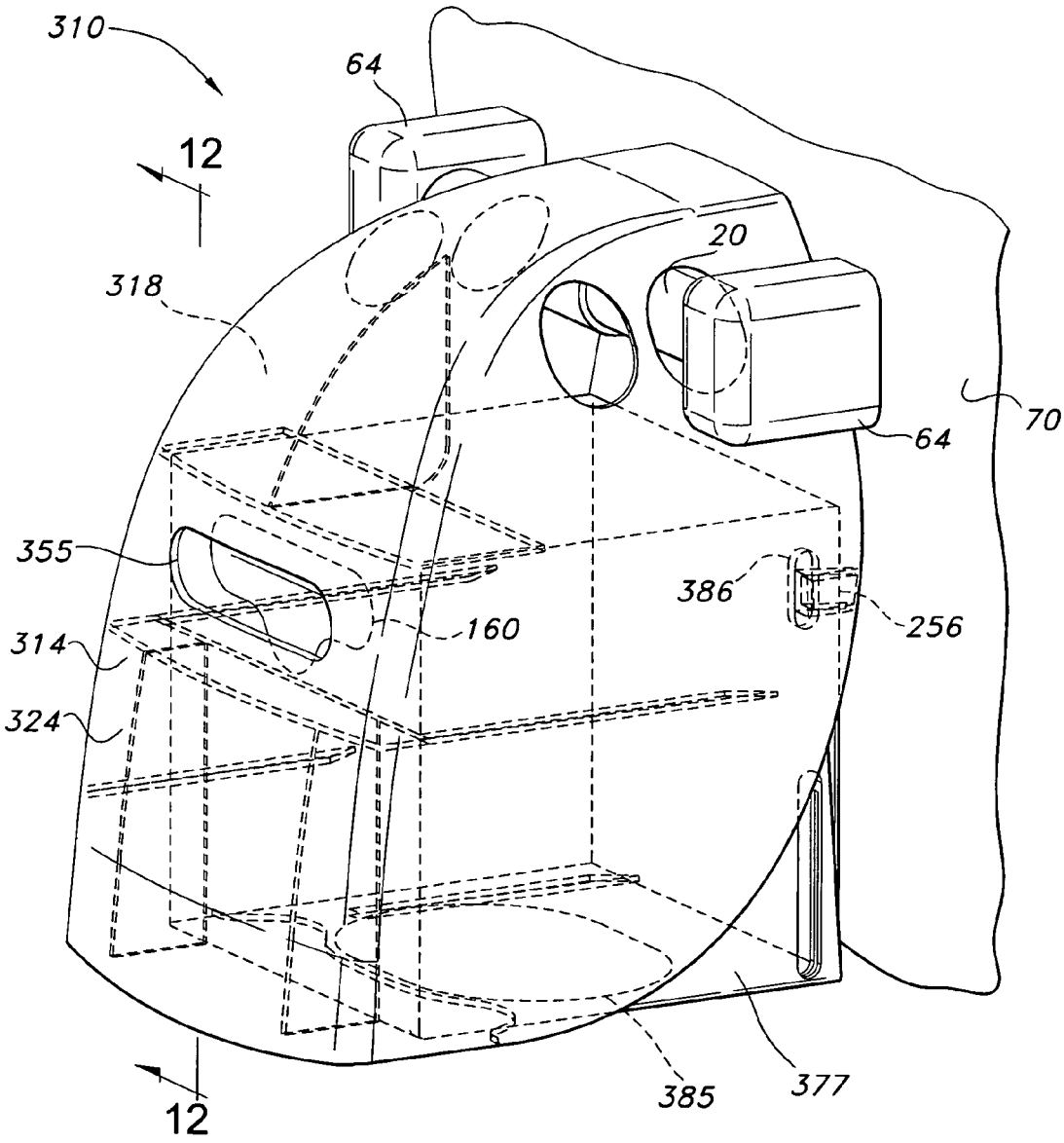
FIG. 7 is a perspective view of still yet another embodiment of the dispenser of the present invention as it is releasably coupled to a conventional rolled product fixture, a cartridge containing dry sheets and a container of premoistened sheets illustrated by phantom lines.
Figure 8:
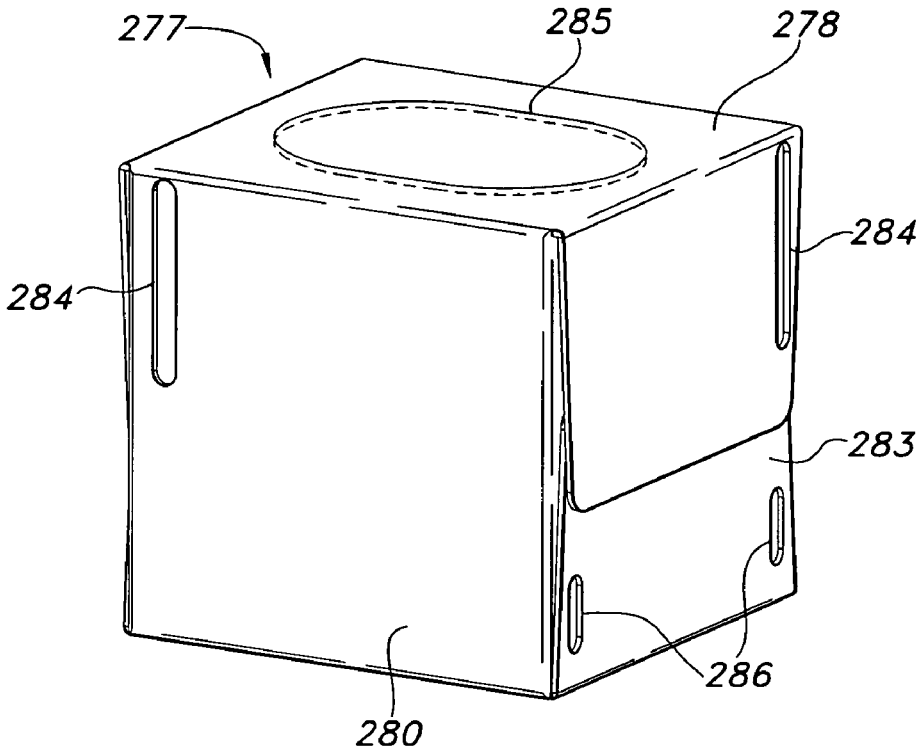
FIG. 8 is a perspective view of the cartridge of dry sheets shown in phantom lines in FIG. 6.
Figure 9:
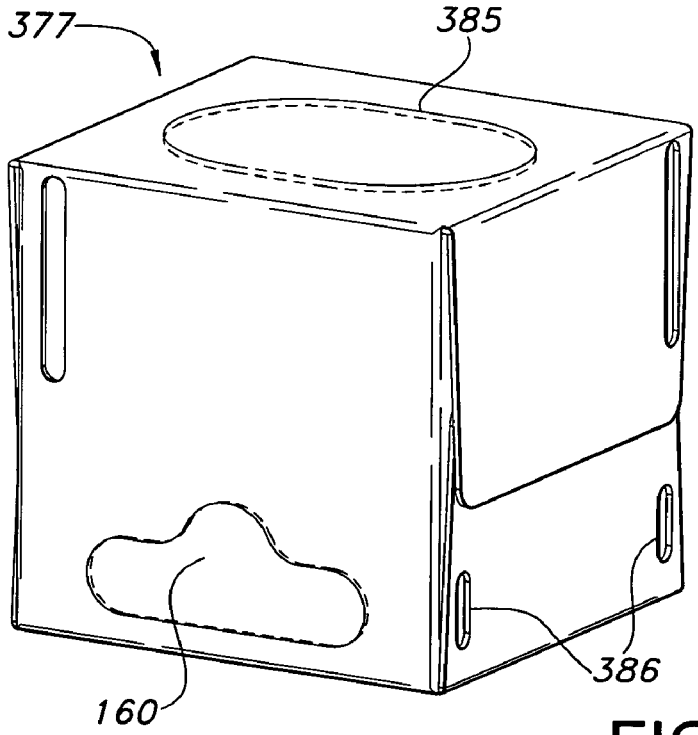
FIG. 9 is a perspective view of the cartridge containing dry sheets and a container or premoistened sheets illustrated in phantom lines in FIG. 7.
Figure 12:
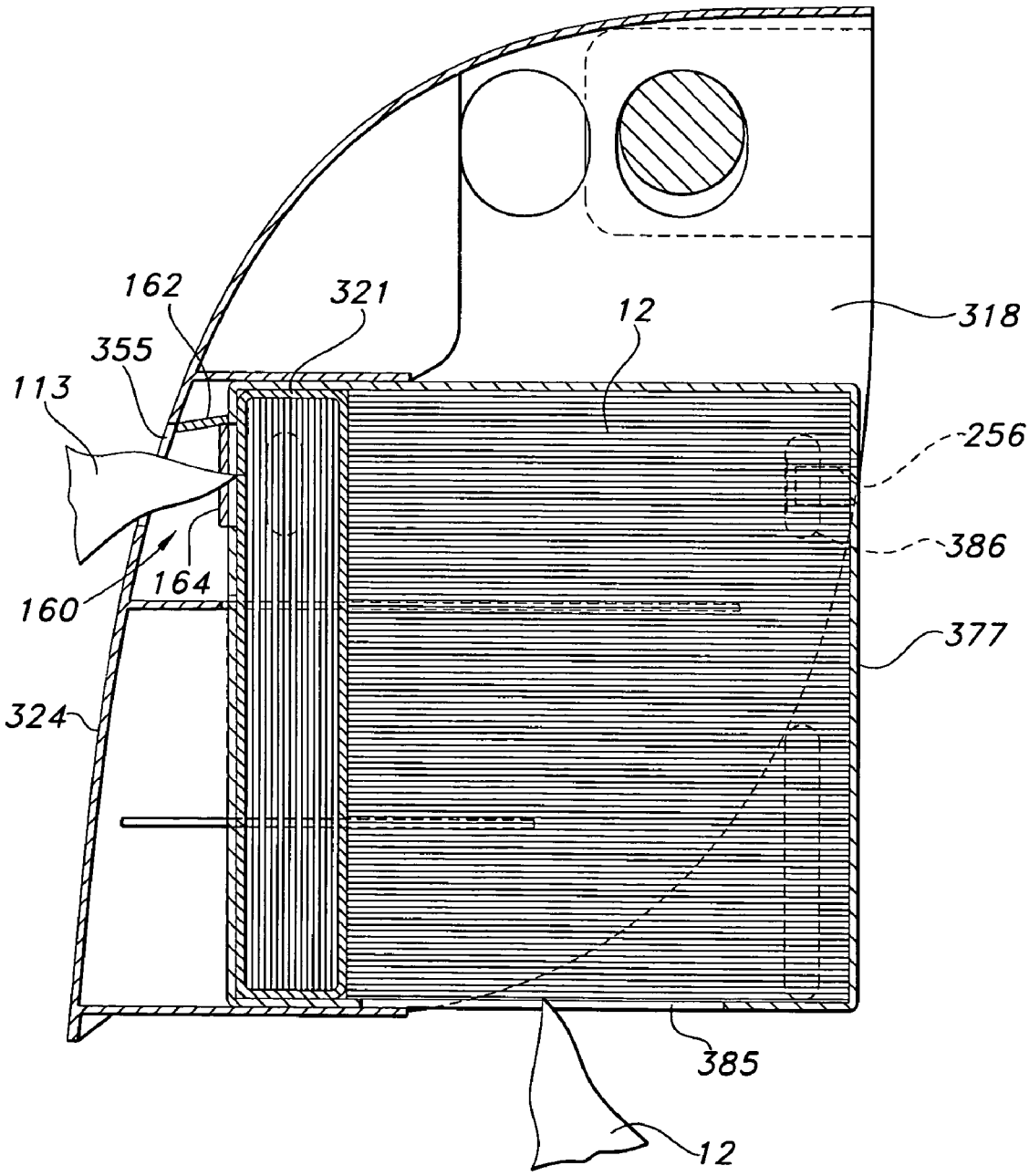
FIG. 12 is a sectional view of FIG. 7 taken along line 12—12, illustrating the position of the cartridge including dry sheets and the container of premoistened sheets in the compartment.

In another embodiment of the invention, as illustrated in FIGS. 7, 9 and 12, the dispenser 310 and housing 314 are very similar to the dispenser 210 and the housing 214 shown in FIGS. 6, 8, 10 and 11, and previously described in detail herein. The dispenser 310, however, is adapted to provide premoistened sheets 113 as well as dry sheets 12 in a single housing 314. A compartment 318 may contain a cartridge 377 of dry sheets 12 which also includes a container 321 of premoistened sheets 113 as well. The container 321 of premoistened sheets 113, as illustrated in FIG. 12, may be formed as a part of the cartridge 377. Alternatively, however, the container 321 of premoistened sheets 113 may be provided separately, without having any attachment to the cartridge 377 of dry sheets 12 (not shown), or it may be provided as a separate container which is coupled to the cartridge (not shown). The premoistened sheets 12 are dispensed from the container 321 within the cartridge 377 from openings (not shown) in the container 321 and cartridge 377 and through a first dispensing opening 355 in the housing 314. The dry sheets 12 are dispensed from another opening 385 in the cartridge 314 (not shown). It will be appreciated that the housing 314 may have any number of openings to permit dispensing of dry sheets 12 and/or premoistened sheets 113 therefrom. Such openings may be provided in any structure of combination of structures, and may be any configuration.

The first dispensing opening 355 desirably is provided, by way of non-limiting example, in the front wall 324. The portion of the cartridge 377 having the container 321 of premoistened sheets 113 is exposed through the first dispensing opening 355, which provides access thereto.

As shown in FIG. 7, a resealable cover 160 may be positioned over the opening in the cartridge 314 and the container 321 of premoistened sheets 113. The resealable cover 160 and the premoistened sheets 113 are then accessed through the first dispensing opening 355 in the housing 314. The resealable cover 160 is aligned over the first dispensing opening 355 to permit dispensing of the premoistened sheets 113 disposed in the cartridge 377 and the container 321. Alternatively, or, in addition thereto, the housing 314 may also include a resealable cover (not shown) which is positioned over the first dispensing opening 355 to permit access to the premoistened sheets 113 as well. The resealable cover 160 and its features, elements and characteristics has been shown and described herein in detail.

The dispenser 314 includes prongs 256. Similarly, the cartridge 377 includes openings 386 similar to openings 286, to permit the cartridge 377 to be releasably coupled to the housing 314. The cartridge 377 releasably couples to the housing 314 in the same manner previously shown and/or described herein. The dispenser 314 and the cartridge 377 may include any feature or characteristic of any dispenser or cartridge shown and/or described herein.

Figure 13:
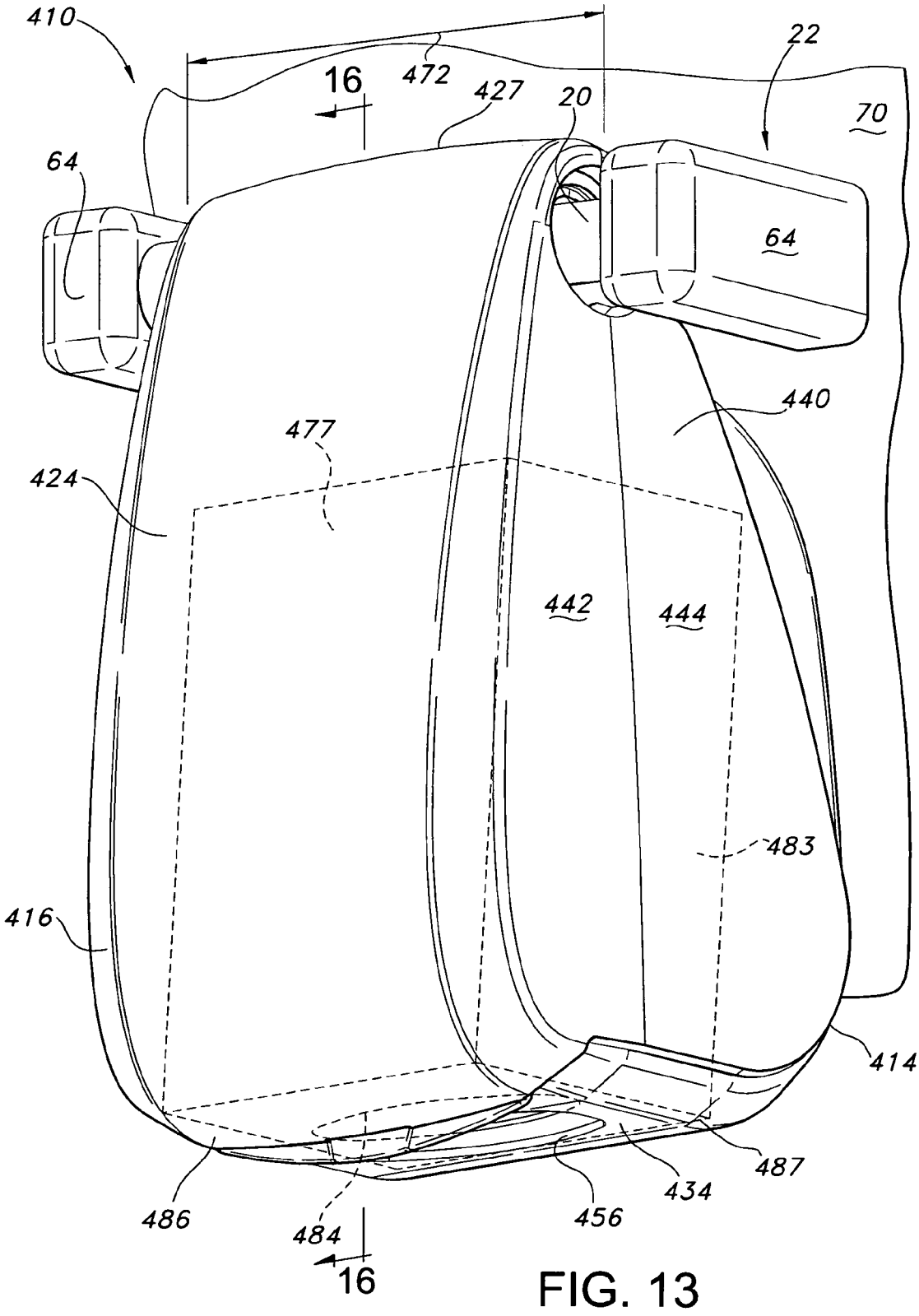
FIG. 13 is a further embodiment of the dispenser of the present invention as it is releasably coupled to a conventional rolled product fixture attached to a vertical support surface, a cartridge of dry sheets illustrated by phantom lines.
Figure 14:
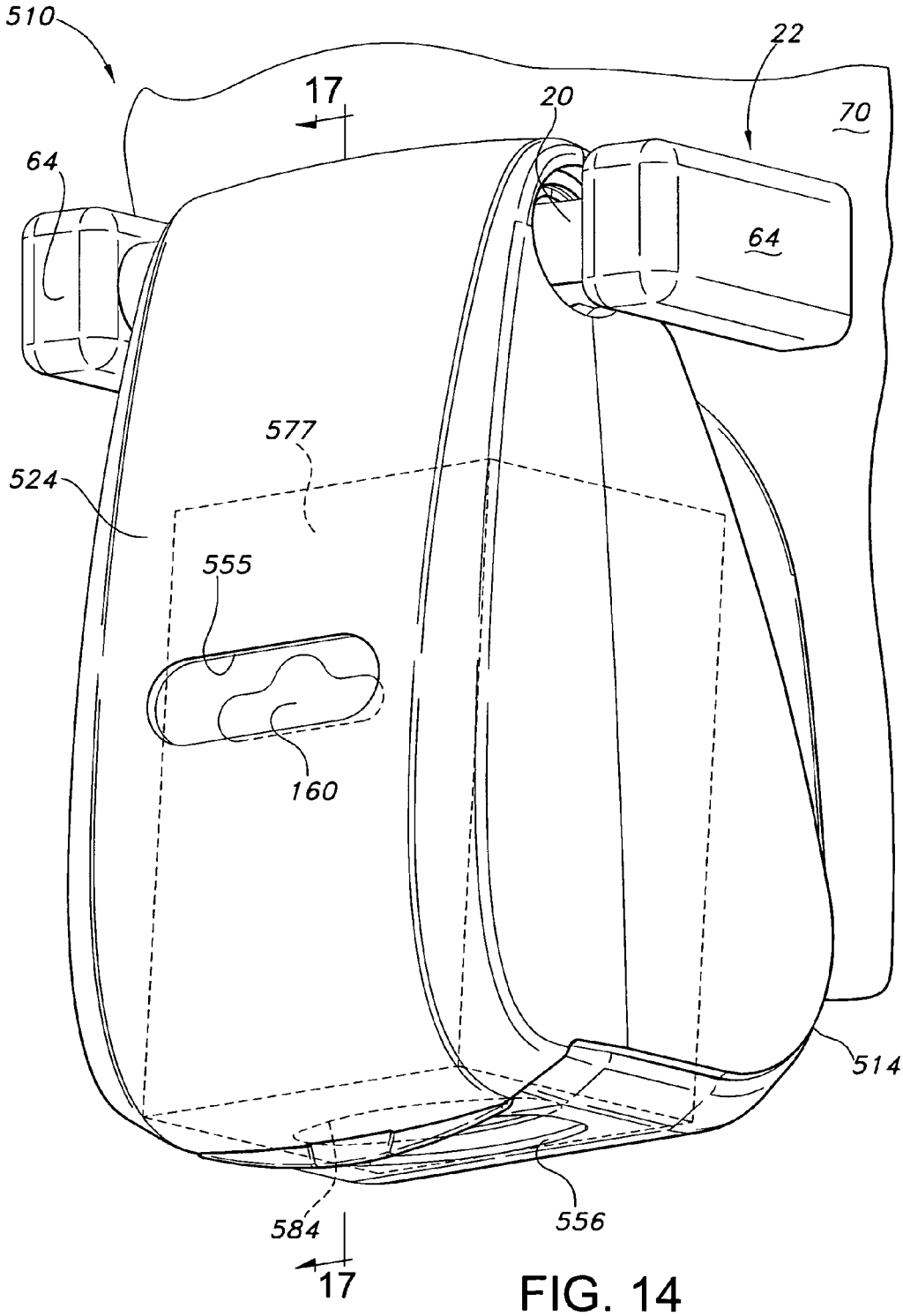
FIG. 14 is yet a further embodiment of the present invention as it is releasably coupled to a conventional rolled product fixture, a cartridge containing dry sheets and a container of premoistened sheets illustrated by phantom lines.
Figure 15:
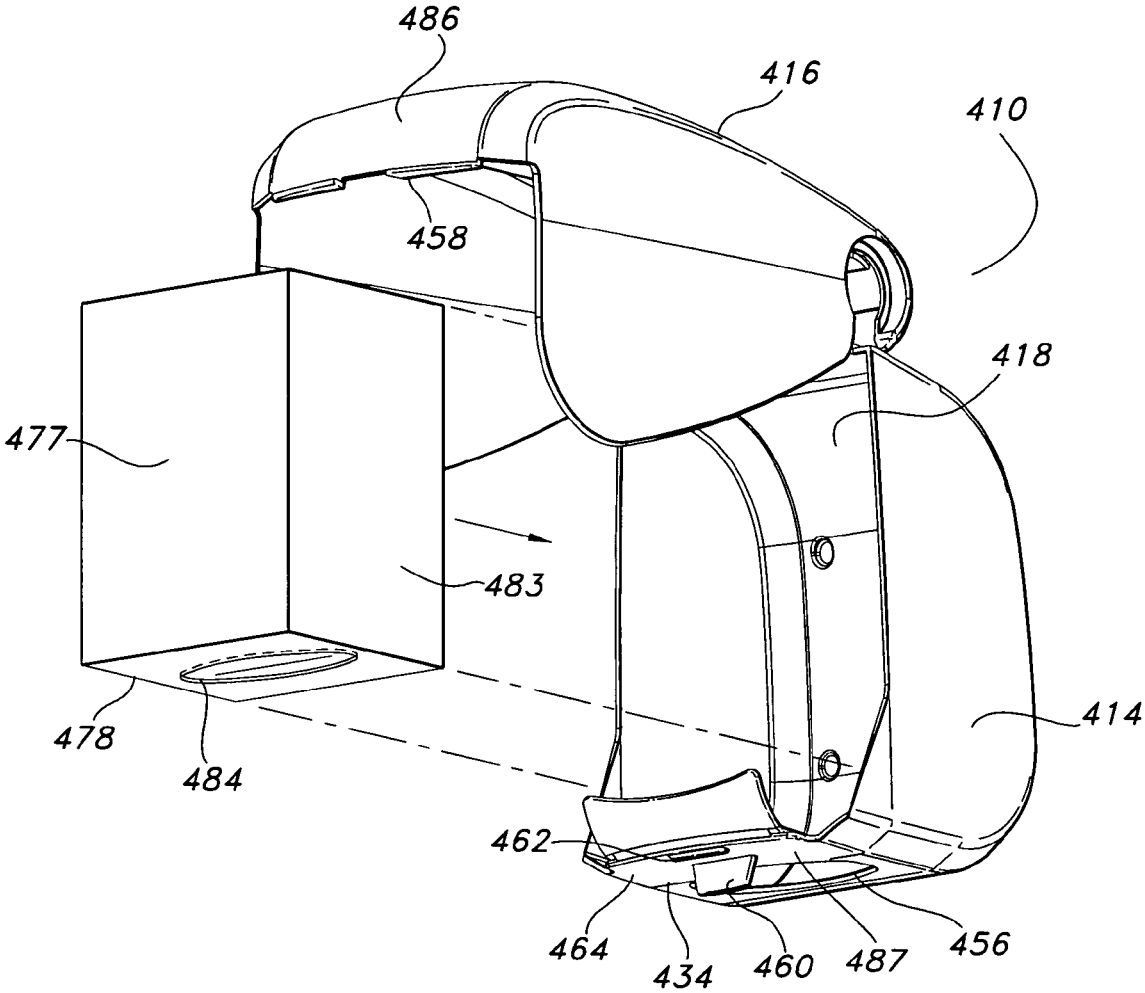
FIG. 15 is an exploded perspective view of the dispenser of FIG. 13, showing the open compartment and the positioned in which the cartridge of dry sheets are to be disposed therein.
Figure 16:
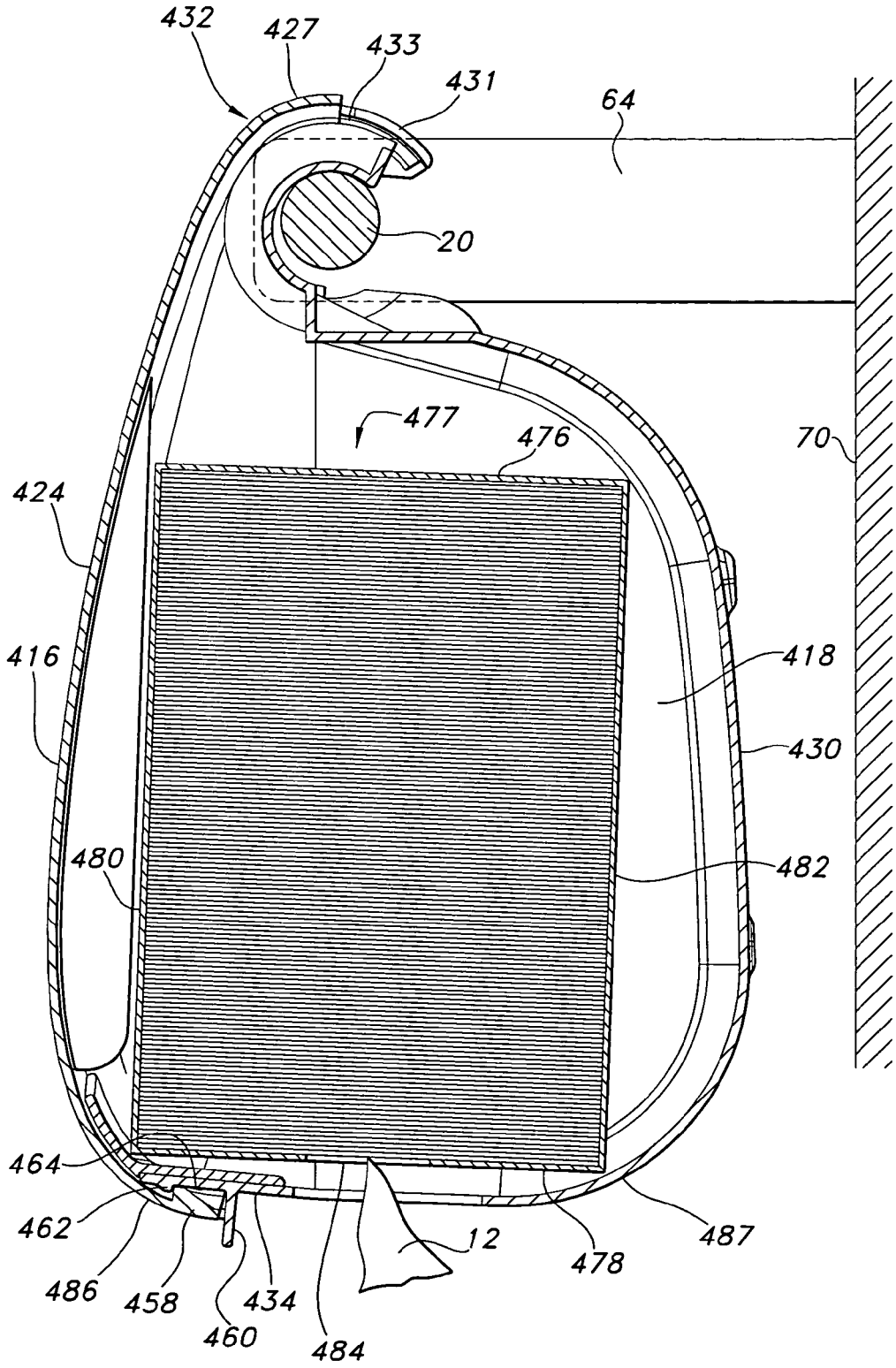
FIG. 16 is a sectional view of FIG. 13 taken along line 16—16, illustrating the position of the cartridge of dry sheets in the compartment.
Figure 17:
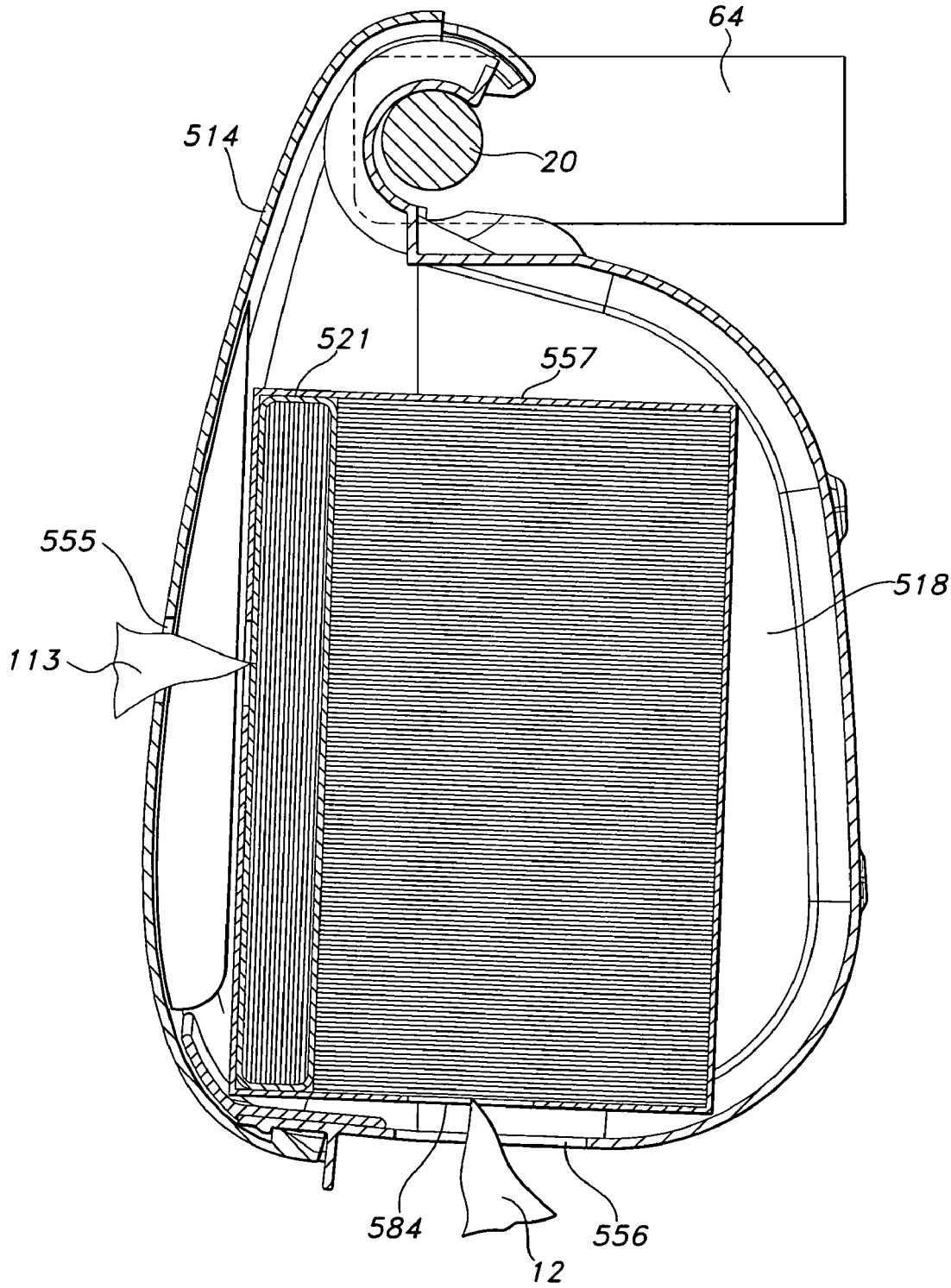
FIG. 17 is a sectional view of FIG. 14 taken along line 17—17, illustrating the position of the cartridge including dry sheets and the container of premoistened sheets in the compartment.

In yet another embodiment of the invention, as illustrated in FIGS. 13, 15 and 16, the dispenser discloses a housing which releasably couples to a conventional rolled product fixture and extends therefrom to provide dry sheets desirably contained in a cartridge for use as toilet tissue. The dispenser shown in FIGS. 14 and 17 is similar, but it is configured to dispense premoistened sheets as well as dry sheets.

Turning to FIGS. 13, 15 and 16, a dispenser 410 according to the invention is provided for dispensing dry sheets 12. The dispenser 410 is similar to the dispenser 10 shown in FIGS. 1, 3 and 4 and described in detail previously. The dispenser includes a housing 414 which has a cover 416. When the cover 416 is positioned adjacent to the housing 414 in a closed dispensing position (FIG. 13), the housing 414 and cover 416 cooperate to provide a compartment 418 from which dry sheets 12 may be dispensing. As illustrated in FIGS. 13 and 16, the dispenser 410 is suspended from a roll mount 20 of a conventional rolled product fixture 22.

The housing 414 includes a front wall 424 having an upper end 427 which extends over adjacent at least a portion of the roll mount 20 to connect the housing 414 to the roll mount 20. Two side walls 440 are provided adjacent to the front wall 424 in a spaced-apart configuration. The at least a portion of the sidewalls 440 and a portion of the cross-section of the housing 414, as shown in FIG. 16, have generally a tear-drop or parabolic configuration. A back wall 430 is also provided adjacent to the sidewalls 440, and includes an upper end 431 which includes a pair of flanges 432. The upper end 431 extends over the roll mount 20. The upper end 427 of the cover 416 includes tracks 433 which are formed to movably mate with the flanges 432 to permit the upper end 427 and the cover 416 to rotate over the flanges 432 to permit the housing 414 to be opened. The upper ends 427, 431 of the front and back walls 424, 430 hook over the roll mount 20. The dispenser 410 may alternatively provide openings in the sidewalls (not shown), as shown and described herein in previous embodiments. A lower end 434 cooperates with the sidewalls 440 and the front and back walls 424, 430 to provide a closure to the housing 414. A dispensing opening 456 is provided in the lower end 434. It will be appreciated that the dispensing opening may be provided in any wall, structure and/or any combination of thereof (not shown) of the housing in any embodiment described and/or illustrated herein, however, to dispense any sheet shown and/or described herein. It will be appreciated that the dispensing opening may take on any suitable shape or configuration.

Each side wall 440 may be provided in two separate front and back sections 442, 444 (FIG. 13). Similarly, the lower end 434 of the housing 414 is provided in a front and back section 486, 487. A latch assembly (FIGS. 15 and 16) is provided to permit closure to the housing 414. The front section 486 of the lower end 434 includes a lip 458 which, in the closed position, abuts a flange 460 on the back section 487 of the lower end 434. The lip 458 is releasably positioned over a ridge 462 provided on the outer surface 464 of the front section 486 of the lower end 434 of the housing 414.

The front wall 424 and the front portion 442 of each sidewall 440 cooperates to provide the cover 416 for the dispenser 410. The cover 416 cooperates with the housing 414 to provide an opening into the compartment 418 in position for disposing dry sheets 12 therein as well as a closure to the housing 414 for dispensing dry sheets 12 therefrom. It will be appreciated that the housing 414 and cover 416 may be connected by one or more hinges, such as living hinges, fasteners, latches, and so forth, to permit access and closure to the compartment 418. In the present embodiment, the upper end 427 of the front wall 424 of the cover 416 is positioned to slide over an adjacent upper end 431 of the back wall 430 of the housing 414 when the cover 416 is lifted to access the compartment 418, as illustrated in FIG. 15. To close the cover 416, the upper end 428 of the cover 416 is moved back into its dispensing position and it is latched closed (FIG. 16).

Referring to FIG. 13, at least the upper end 427 housing 414 has a configuration with a width dimension 472 which extends between opposing side walls 440 which is less than the width dimension 62 of the support arms 64 (FIG. 1) provided with a conventional rolled product fixture 22. The various dimensions of the housing 414 are desirably configured such that the dispenser 410 may be coupled to and supported by the fixture 22. The fixture 22, roll mount 20, support arms 64, and structures and elements thereof have been shown and described in detail herein.

The width dimension 472 of the housing 414 is desirably in a range of about 5.5 inches to about 4.7 inches. Even more desirably, the width dimension 472 is in a range of about 5.25 inches to about 4.6 inches. Yet even more desirably, the width dimension 472 is in a range of about 5.25 inches to about 4.5 inches.

The dispenser 410 is opened when the cover 416 is moved away from the housing 414, as illustrated in FIG. 15, so that the dry sheets 12 may be positioned in the compartment 418. Dry sheets 12 may be provided as an unbound stack or dry sheets 12 (not shown). Desirably, the dry sheets 12 are desirably provided in a cartridge 477 of dry sheets 12. Such a cartridge 477 is formed to include upper and lower surfaces 476, 478, as well as front and back walls 480, 482. The cartridge 477 may provide side walls 483 as well. Any cartridge shown and/or described herein may be utilized.

An opening 484 may be provided in at least one surface or wall of the cartridge 477, such as in a lower surface 478 of the cartridge 477. The opening 484 in the cartridge desirably is positioned to be aligned with the dispensing opening 456 in the housing 414 to permit dispensing of the dry sheets 12 from the cartridge 477. It will be understood that the opening 484 may be provided in any structure or combinations of structures; it will be appreciated that the opening may assume any shape or configuration.

The cartridge 477 or an unbound stack of sheets (not shown) is desirably positioned generally parallel relative to the adjacent vertical support surface 70 as illustrated in FIG. 16. In addition, the upper and/or lower surfaces 476, 478 of the cartridge 477 is positioned perpendicular relative to the adjacent vertical support surface 70. Desirably, but not by way of limitation, the cartridge 477 may have a substantially polygonal configuration.

The housing 414 is provided such that corners are rounded. Such structure is provided for user safety.

An aperture which reveals the amount of tissue in the compartment may be provided near the lower end of the housing 414 (not shown). Such an aperture provides an indication of whether there is sufficient tissue in the compartment, or whether a refill may be needed. Alternatively, at least a portion of the housing may be clear or tinted to show the amount of sheets remaining in the compartment (not shown).

The housing 414 and cartridge 477 may be formed from any material shown and/or described herein. The housing 414 and the cartridge 477 may have any feature or characteristic shown and/or described herein. The housing 414 and cartridge 477 may be provided in any shape or configuration, and the present embodiment is provided as a non-limiting example thereof.

In another embodiment of the invention, as illustrated in FIGS. 14 and 17, the dispenser 510 and housing 514 are very similar to the dispenser 10, 410 and the housing 14, 414 shown in FIGS. 2, 5, 13, 15, and 16 and previously described in detail herein. The dispenser 510, however, is adapted to dispense premoistened sheets 113 as well as dry sheets 12 from a single housing 514. The compartment 518 contains a cartridge 577 of dry sheets 12 which also includes, by way of non-limiting example, a container 521 of premoistened sheets 113 as well. The container 521 of premoistened sheets 113, as illustrated in FIG. 17, may be formed as a part of the cartridge 577. Alternatively, however, the container 521 of premoistened sheets 113 may be provided separately, without having any attachment to the cartridge 577 (not shown), or it may be provided as a separate container which is coupled to the cartridge (not shown). The premoistened sheets 113 are dispensed from the container 521 within the cartridge 577 through openings in the container 521 and cartridge 577 (not shown) and through a first dispensing opening 555 in the housing 514. The dry sheets 12 are dispensed from an opening 584 in the cartridge 577 and through a second dispensing opening 556 in the housing 514, as shown in FIG. 17.

The first dispensing opening 555 desirably is provided in the housing 514, by way of non-limiting example, in the front wall 524. The portion of the cartridge 577 having the container 521 of premoistened sheets 113 is exposed through the first dispensing opening 555 of the housing 514, which provides access thereto.

As shown in FIGS. 14 and 17, a resealable cover 160 may be positioned over the opening in the cartridge 577 and the container 521 of premoistened sheets 113. The resealable cover 160 is positioned in alignment with the first dispensing opening 555 in the housing 514 to permit dispensing of the premoistened sheets 12 disposed in the cartridge 577 and container 521. Alternatively, or, in addition thereto, the housing 514 may also include a resealable cover 160 which is positioned over the first dispensing opening 555 on a surface of the housing 514 to permit access to the premoistened sheets 113 as well (not shown). The elements, features, and characteristics of the resealable cover 160 have been described previously herein.

The premoistened sheets 113 and the container 521 may include any feature and/or characteristic shown and/or described herein. The container may be formed from any material shown and/or described herein.

The cartridge 577 or an unbound stack of sheets (not shown) is desirably positioned generally parallel relative to the adjacent vertical support surface 70 as illustrated generally by dispenser 410 and cartridge 477 in FIG. 16. In addition, the upper and/or lower surfaces of the cartridge 577 is positioned perpendicular relative to the adjacent vertical support surface 70. Desirably, but not by way of limitation, the cartridge 577 may have a substantially polygonal configuration.

The housing 514 and cartridge 577 may be formed from any material shown and/or described herein. The housing 514 and the cartridge 577 may have any feature or characteristic shown and/or described herein. The housing 514 and cartridge 577 may be provided in any shape or configuration, and the present embodiment is provided as a non-limiting example thereof.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to releasably couple to a rolled product fixture which is coupled to a vertical support surface, the fixture including a roll mount, the dispenser comprising:

a housing having a compartment for holding sheets therein and including a dispensing opening, the housing including a plurality of walls which cooperate to provide the compartment including a pair of spaced-apart side walls formed to include openings therein, the openings positioned adjacent a junction provided by a pair of spaced-apart upper walls, the junction forming a first angle, the housing including a pair of spaced-apart lower walls that form another junction which provides a second angle, the housing configured such that when the housing is coupled to a fixture which is coupled to a vertical support surface, a roll mount of the fixture is positioned through the openings of the housing to releasably couple the housing to the fixture and suspend the housing from the roll mount of the fixture such that the first angle provides a highest vertex of the housing and the second angle provide a lowest vertex of the housing, and wherein a first axis positioned through the highest vertex and the lowest vertex of the housing is positioned substantially vertical relative to the vertical support surface when the housing is coupled to the fixture.

2. The dispenser of claim 1, wherein upper walls are configured at an acute angle relative to each other.

3. The dispenser of claim 2, wherein the acute angle of the upper walls is in a range of about 25 degrees to about 50 degrees.

4. The dispenser of claim 1, wherein the housing is non-refillable.

5. The dispenser of claim 1, wherein the angle of the lower walls is in a range of about 80 degrees to about 100 degrees.

6. The dispenser of claim 1, wherein the housing includes a junction of at least one upper wall to at least one lower wall, and at the junction an obtuse angle is formed which is in a range of about 100 to about 150 degrees.

7. The dispenser of claim 1, wherein the dispenser is releasably coupled to a fixture, the housing is positioned diagonally with respect to its connection with a fixture.

8. The dispenser of claim 1, wherein the sheets comprise a plurality of sheets in a cartridge.

9. The dispenser of claim 8, wherein the cartridge includes a band positioned about a plurality of sheets.

10. The dispenser of claim 8, wherein the cartridge substantially covers a plurality of sheets, the cartridge including at least one dispensing opening.

11. The dispenser of claim 1, wherein the housing includes a cover.

12. The dispenser of claim 1, wherein the cover is connected to the housing by one of fasteners, hinges, latches, or any combination thereof.

13. The dispenser of claim 8, wherein the sheets are positioned in the housing are one of stacked, interfolded, and festooned.

14. The dispenser of claim 8, wherein the sheets are further defined as dry sheets.

15. The dispenser of claim 14, wherein the sheets are further defined as toilet tissue sheets.

16. The dispenser of claim 8, wherein the sheets include dry sheets and premoistened sheets.

17. The dispenser of claim 16, wherein the premoistened sheets are disposed in a container.

18. The dispenser of claim 17, wherein the container of premoistened sheets is provided as a portion of a cartridge.

19. The dispenser of claim 1, wherein the upper walls couple to lower walls forming junctions therebetween and a second axis extends through the junctions of the upper and lower walls.

20. The dispenser of claim 19, wherein the second axis is substantially horizontal to the vertical support surface when the dispenser is suspended from the roll mount of the fixture.

21. The dispenser of claim 1, wherein the housing is refillable.

22. The dispenser of claim 1, wherein the housing includes a resealable cover.

23. The dispenser of claim 1, wherein the housing is constructed of paper, paperboard, plastic, polymer film, cellophane, wood, metal, fabric, fiber, or any combination thereof.

24. The dispenser of claim 20, wherein the first axis and the second axis are substantially perpendicular to one another.

25. A dispenser assembly including a dispenser is adapted to releasably couple to a rolled product fixture which is coupled to a vertical support surface, the fixture including a roll mount, the dispenser assembly comprising:

a dispenser including a housing having a compartment for holding sheets therein and including a dispensing opening, the housing including a plurality of walls which cooperate to provide the compartment including a pair of spaced-apart side walls formed to include openings therein, the openings positioned adjacent a junction provided by a pair of spaced-apart upper walls, the junction forming a first angle, the housing including a pair of spaced-apart lower walls that form another junction which provides a second angle, the housing configured such that when the housing is coupled to a fixture which is coupled to a vertical support surface, a roll mount of the fixture is positioned through the openings of the housing to releasably couple the housing to the fixture and suspend the housing from the roll mount of the fixture such that the first angle provides a highest vertex of the housing and the second angle provide a lowest vertex and the lowest vertex of the housing is positioned substantially vertical relative to the vertical support surface when the housing is coupled to the fixture; and a cartridge configured to be positioned in the compartment, the cartridge having a plurality of sheets therein, the cartridge having a dispensing opening from which sheets dispense which is aligned with the dispensing opening of the housing when the cartridge is positioned in the compartment.

26. The dispenser assembly of claim 25, wherein an acute angle is formed at a junction of the upper walls, and the acute angle is in a range of about 25 degrees to about 50 degrees.

27. The dispenser assembly of claim 25, wherein the angle formed at a junction of the lower walls is in a range of about 80 degrees to about 100 degrees.

28. The dispenser assembly of claim 25, wherein upper walls couple to lower walls forming junctions therebetween and a second axis extends through the junctions of the upper and lower walls which is substantially horizontal relative to the vertical support surface when the dispenser is suspended from the roll mount of the fixture.

29. The dispenser assembly of claim 25, wherein the cartridge is one of a band positioned substantially about a plurality of sheets and a cover which extends substantially about the plurality of sheets.

30. The dispenser assembly of claim 25, wherein the sheets are further defined as dry sheets which comprise toilet tissue sheets.

31. The dispenser assembly of claim 25, wherein the sheets include dry sheets and a container of premoistened sheets.

* * * * *